US010136696B2

(12) United States Patent
Frappier

(10) Patent No.: US 10,136,696 B2
(45) Date of Patent: Nov. 27, 2018

(54) SKATE BOOT TONGUE

(71) Applicant: Sport Maska Inc., Montreal (CA)

(72) Inventor: Justin Frappier, Montreal (CA)

(73) Assignee: SPORT MASKA INC., Montreal, Quebec ( * ) Notice: Subject to any disclaimer, the term of this patent is extended or adjusted under 35 U.S.C. 154(b) by 98 days.

(21) Appl. No.: 14/820,791

(22) Filed: Aug. 7, 2015

(65) Prior Publication Data

US 2015/0342294 A1 Dec. 3, 2015

Related U.S. Application Data

(63) Continuation of application No. 12/981,633, filed on Dec. 30, 2010, now Pat. No. 9,119,441.

(51) Int. Cl.

| | |
|---|---|
| ***A43B 5/16*** | (2006.01) |
| ***A43B 7/08*** | (2006.01) |
| ***A43B 23/26*** | (2006.01) |

(52) U.S. Cl.

CPC ..... *A43B 5/16* (2013.01); *A43B 5/1675* (2013.01); *A43B 7/085* (2013.01); *A43B 23/26* (2013.01)

(58) Field of Classification Search

CPC ..... A43B 7/06; A43B 7/081; A43B 23/02; A43B 23/26; A43B 23/086; A43B 23/082; A43B 5/0401; A43B 5/1666; A43B 3/0078

USPC ..... 36/54, 77 R, 115

See application file for complete search history.

(56) References Cited

U.S. PATENT DOCUMENTS

| | | | | | |
|---|---|---|---|---|---|
| 601,192 | A | | 3/1898 | Woodside | |
| 623,350 | A | | 4/1899 | Blanc | |
| 1,253,777 | A | * | 1/1918 | Bromley | A43B 23/26 24/714.6 |
| 3,995,382 | A | * | 12/1976 | Smith | A43B 23/082 36/72 R |
| 4,458,429 | A | | 7/1984 | Schmid | |
| 4,507,880 | A | | 4/1985 | Ohashi | |
| 4,509,276 | A | | 4/1985 | Bourque | |
| 4,805,321 | A | | 2/1989 | Tonkel | |
| 4,920,666 | A | | 5/1990 | Marega | |
| 5,171,033 | A | * | 12/1992 | Olson | A43B 7/081 280/11.202 |
| 5,174,050 | A | | 12/1992 | Gabrielli | |
| 5,265,353 | A | | 11/1993 | Marega et al. | |

(Continued)

FOREIGN PATENT DOCUMENTS

| | | |
|---|---|---|
| CA | 2071806 | 7/1993 |
| WO | 2007126991 A2 | 11/2007 |

*Primary Examiner* — Megan Lynch

(74) *Attorney, Agent, or Firm* — Norton Rose Fulbright Canada

(57) ABSTRACT

A skate boot having a shell shaped to enclose a heel, portions of an Achilles tendon, and medial and lateral surfaces of a foot of a wearer of the skate boot when the skate is in use by the wearer, a toe cap connected to the shell and shaped to cover the toes of the wearer when the skate is in use by the wearer, a tongue connected to at least one of the shell and the toe cap, the tongue being shaped to cover at least a portion of a forefoot of the wearer when the skate is in use by the wearer, and a ground-engaging element connected to a bottom of the skate boot. The tongue has at least one exposed structural molded foam body, and a plurality of apertures defined within the at least one exposed structural molded foam body.

18 Claims, 21 Drawing Sheets

(56) References Cited

U.S. PATENT DOCUMENTS 5,357,695 A * 10/1994 Lu ..... A43B 5/1633 36/115
5,365,677 A 11/1994 Dahlgren
5,511,323 A 4/1996 Dahlgren
D375,618 S 11/1996 Chen
5,647,146 A * 7/1997 Gabrielli ..... A43B 5/0405 36/10
5,659,979 A * 8/1997 Sileo ..... A43B 1/0072 206/223
5,678,833 A * 10/1997 Olson ..... A43B 3/26 280/11.224
6,082,028 A * 7/2000 Demarchi ..... A43B 5/16 36/10
6,128,837 A 10/2000 Huang
6,321,466 B1 11/2001 Bordin et al.
6,360,454 B1 3/2002 Dachgruber et al.
6,381,877 B2 5/2002 Filice
6,401,364 B1 6/2002 Burt
D468,521 S 1/2003 Wilson
7,257,906 B2 8/2007 Jones et al.
7,290,355 B2 11/2007 Labonte
7,325,813 B2 2/2008 Bock
7,451,991 B2 11/2008 Labonte
7,523,567 B1 4/2009 McClelland
8,359,769 B2 1/2013 Vattes et al.
8,387,286 B2 3/2013 Koyess et al.
2001/0042324 A1 11/2001 Filice
2002/0029494 A1 3/2002 Small
2002/0053147 A1* 5/2002 Borsoi ..... A43B 5/0401 36/54
2002/0153704 A1* 10/2002 Okajima ..... A43B 5/0401 280/618
2003/0014882 A1 1/2003 Bettiol
2004/0016150 A1 1/2004 Labonte et al.
2004/0111918 A1 6/2004 Van Noy et al.
2004/0187351 A1* 9/2004 Jones ..... A43B 1/0027 36/54
2005/0126046 A1 6/2005 Labonte et al.
2005/0204585 A1* 9/2005 Loveridge ..... A43B 1/0018 36/54
2005/0217146 A1* 10/2005 Jones ..... A43B 23/081 36/54
2005/0223598 A1* 10/2005 Jones ..... A43B 1/0027 36/54
2006/0051566 A1 3/2006 Challe
2006/0277785 A1 12/2006 Vattes et al.
2008/0127519 A1 6/2008 Byrne et al.
2008/0172906 A1 7/2008 Jou et al.
2009/0071041 A1 3/2009 Hooper
2010/0156058 A1* 6/2010 Koyess ..... A43B 5/1616 280/11.12
2011/0126431 A1 6/2011 Mazzarolo
2012/0025478 A1 2/2012 Van Horne et al.
2012/0124863 A1 5/2012 Aveni et al.
2013/0214499 A1 8/2013 Koyess et al.

* cited by examiner

SKATE BOOT TONGUE

CROSS-REFERENCE TO RELATED APPLICATION

This application is a continuation of U.S. application Ser. No. 12/981,633 filed Dec. 30, 2010, the entire contents of which are incorporated by reference herein.

FIELD OF THE INVENTION

The present invention relates generally to a skate boot tongue and to a skate boot having a skate boot tongue.

BACKGROUND

Skates, such as ice skates or roller skates, typically have a skate boot and a ground-engaging element, such as a skate blade or a set of wheels. The skate boot typically has a shell, a toe cap, and tongue covering at least a portion of the forefoot of a skater when the skate is in use. The tongue is stitched or otherwise permanently connected to the toe cap. The tongue typically comprises layers of different materials stitched together, including a felt (or other soft material) inner liner, a leather outer shell, and a lacebite component made of suitable hard material (such as a thick piece of leather or a plastic insert). The inner liner is the innermost layer of the assembly and rests against the skater's foot. The leather outer shell provides structure to the tongue and protection to at least a portion of the skater's forefoot. The lacebite component is the outermost and stiffest component of the tongue; it provides structure to the tongue and distributes the pressure applied by the skate boot lace on the skater's forefoot when the skate is in use.

Since the various layers of materials described above are sewn together, manufacturing and assembling typical skate boot tongues may be relatively complex, time consuming and expensive. In certain instances, stitches may be prone to wear and lead to premature break down of the tongue. In certain instances, stitches may also rub against a skater's forefoot, creating discomfort for the skater.

Furthermore, the shape, length, thicknesses, rigidity, and support and protection properties of a tongue may have a significant impact on a skater comfort and performance considering the skater's particular skating style and physical characteristics. However, the typical skate boot tongue cannot be adapted to a user's particular skating style and physical characteristics. A skater may wish to use skate boots with different fit, comfort, and support depending on the conditions under which the skate will be used and therefore, a single skater may need to have different pairs of skates for each condition under which the skates are used, or otherwise use a single pair of skates that is a compromise between the various desired features.

Traditional skate boot tongues that provide enhanced support are generally more rigid and less comfortable, while more flexible and comfortable tongues provide less support.

Furthermore, traditional skate boot tongues made of a plurality of layers of different materials tend to be heavy and not to breathe appropriately. When the skate boot is in use, traditional tongues can tend to capture the moisture from the skater's foot, which can make them even heavier and less comfortable.

Finally, the aesthetic properties of skate boots are increasingly important for skate consumers and contribute to the skater's skating experience. However, the above described construction of traditional skate boot does not leave much room for improvements of the tongue's appearance and changes thereto may be time consuming and expensive from a manufacturing perspective.

Therefore, there is a need for a more durable skate boot tongue having a simpler construction, which may not require any stitching or only a limited amount of stitching. There is also a need for a skate boot tongue having enhanced breathing or ventilation properties and having a structural body made of a material that would be easy to manufacture with different rigidity and flexibility properties, that provides a good compromise between rigidity and comfort, and that may be adapted to a particular skater's needs. There is also a need for a skate boot tongue that may easily and inexpensively be manufactured with a wide variety of aesthetic features. Finally, there is still a need for a skate boot tongue that could easily be replaced by a skate owner.

SUMMARY

In one aspect, the present skate ameliorates at least some of the inconveniences present in the typical skate boot tongues.

In one aspect, there is provided a skate boot tongue that is more durable, simpler and cheaper to manufacture and assemble, more comfortable and providing localised support and flexibility, easier to customise based on a skater's particular needs, and more interesting from an aesthetic perspective.

In one aspect, there is provided a skate boot tongue which may be easily replaced by a skate owner. Such a skate boot tongue would, for example, allow a hockey player to have a single pair of ice skates and use a thick tongue and/or a tongue made of a more rigid material during training to avoid injuries, and a thinner tongue and/or a tongue made of a more flexible material during a game to improve performance. Furthermore, since the tongue is releasably connected to the skate boot, a manufacturer may offer only a few different models of skate boots and combine those skate boot models with a wide variety of different tongues adapted to the needs of different type of skaters and to different skating conditions.

In one aspect, there is provided a tongue for a skate boot comprising at least one exposed structural molded foam body, and a plurality of apertures defined within the at least one exposed structural molded foam body.

In one aspect, the at least one exposed structural molded foam body defines a central longitudinal axis, and the plurality of apertures is at least two apertures. At least one of the at least two apertures is disposed on one side of the central longitudinal axis and at least one other of the at least two apertures is disposed on another side of the central longitudinal axis.

In a further aspect, the tongue further comprises a plurality of recesses defined in the at least one exposed structural molded foam body.

In an additional aspect, the at least one exposed structural molded foam body defines a central longitudinal axis and has an outer surface, the plurality of recesses is at least two grooves defined within the outer surface of the molded foam body, and at least one of the at least two grooves is disposed on one side of the central longitudinal axis and at least one other of the at least two grooves is disposed on another side of the central longitudinal axis.

In a further aspect, the at least two grooves extend so as to define at least one angle with respect to the central longitudinal axis.

In an additional aspect, at least one of the plurality of apertures is disposed within at least one of the plurality of recesses.

In a further aspect, substantially all of the plurality of apertures are disposed within at least a plurality of the plurality of recesses.

In an additional aspect, the plurality of apertures is at least two apertures, and at least one of the at least two apertures is disposed within at least one of the two grooves and at least one other of the at least two apertures is disposed within another of the at least two grooves.

In a further aspect, the at least one exposed structural molded foam body is made of one of injected foam, compressed foam and expanded foam.

In an additional aspect, the at least one exposed structural molded foam body is made of expanded ethylene-vinyl acetate (EVA) foam.

In a further aspect, the at least one exposed structural molded foam body has a Shore D durometer ranging from approximately 40 to approximately 80.

In an additional aspect, the at least one exposed structural molded foam body has a ShoreD durometer ranging from approximately 55 to approximately 65.

In a further aspect, the tongue further comprises a back liner for facing a user's foot, the back liner being connected to the at least one exposed structural molded foam body.

In an additional aspect, the back liner is made of one of felt, molded foam having a lower density or hardness than the at least one exposed structural molded foam body, and soft synthetic material.

In a further aspect, the back liner is one of glued, laminated and stitched to the at least one exposed structural molded foam body, and edges of the plurality of apertures are not stitched to the back liner.

In an additional aspect, the tongue further comprises an exposed tongue cover. The tongue cover comprises at least one layer of molded foam having a higher density or hardness than the at least one exposed structural molded foam body. The tongue cover is one of laminated and glued to the at least one exposed structural molded foam body.

In a further aspect, the tongue further comprises a connector adapted to cooperate with at least one structure of a skate boot for releasably securing the tongue to the skate boot.

In an additional aspect, the connector is one of integrally formed with the at least one exposed structural molded foam body, releasably connected to the at least one exposed structural molded foam body, and permanently connected to the at least one exposed structural molded foam body.

In a further aspect, the connector is not connected to the at least one exposed structural molded foam body until the tongue is releasably secured to the skate boot.

In an additional aspect, the skate boot has a toe cap having a top surface, the at least one structure of a skate boot is at least one aperture defined within the top surface of the toe cap, and the at least one aperture has at least one edge. The connector is adapted to pass through the at least one aperture of the top surface of the toe cap. At least a portion of the connector is adapted to fit in the at least one aperture of the top surface of the toe cap, and at least one portion of the connector is adapted to cooperate with the at least one edge of the at least one aperture of the top surface of the toe cap.

In a further aspect, the at least one portion of the connector that is adapted to cooperate with the at least one edge of the at least one aperture of the top surface of the toe cap cooperates with the at least one edge of the at least one aperture of the top surface of the toe cap so as to releasably secure the tongue to the skate boot.

In an additional aspect, the skate boot has a lace, and the connector is adapted to receive a portion of the lace.

In a further aspect, the skate boot has a toe cap and a tongue connector. The plurality of apertures defined within the at least one exposed structural molded foam body are a first set of apertures. The at least one exposed structural molded foam body further comprises at least one additional aperture defined within the at least one exposed structural molded foam body which is not part of the first set of apertures. The at least one additional aperture being adapted to receive at least a portion of the tongue connector so as to releasably secure the tongue to the toe cap.

It is also another object of the present invention to provide a skate boot comprising a shell shaped to enclose a heel, portions of an Achilles tendon, and medial and lateral surfaces of a foot of a wearer of the skate boot when the skate is in use by the wearer. The skate boot further comprises a toe cap connected to the shell and shaped to cover the toes of the wearer when the skate is in use by the wearer, and a tongue connected to at least one of the shell and the toe cap. The tongue is shaped to cover at least a portion of a forefoot of the wearer when the skate is in use by the wearer. The tongue comprises at least one exposed structural molded foam body and a plurality of apertures defined within the at least one exposed structural molded foam body. The skate boot also comprises a ground-engaging element connected to a bottom of the skate boot.

In an additional aspect, the skate boot is for one of an ice skate and a roller skate In a further aspect, the at least one exposed structural molded foam body defines a central longitudinal axis, the plurality of apertures is at least two apertures, and at least one of the at least two apertures is disposed on one side of the central longitudinal axis and at least one other of the at least two apertures is disposed on another side of the central longitudinal axis.

In an additional aspect, a plurality of recesses is defined in the at least one exposed structural molded foam body.

In a further aspect, the at least one exposed structural molded foam body defines a central longitudinal axis and has an outer surface, the plurality of recesses is at least two grooves defined within the outer surface of the molded foam body, and at least one of the at least two grooves is disposed on one side of the central longitudinal axis and at least one other of the at least two grooves is disposed on another side of the central longitudinal axis.

In an additional aspect, the at least two grooves extend so as to define at least one angle with respect to the central longitudinal axis.

In a further aspect, at least one of the plurality of apertures is disposed within at least one of the plurality of recesses.

In an additional aspect, substantially all of the plurality of apertures are disposed within at least a plurality of the plurality of recesses.

In a further aspect, the plurality of apertures is at least two apertures, and at least one of the at least two apertures is disposed within at least one of the two grooves and at least one other of the at least two apertures is disposed within another of the at least two grooves.

In an additional aspect, the at least one exposed structural molded foam body is made of one of injected foam, compressed foam and expanded foam.

In a further aspect, at least one exposed structural molded foam body is made of expanded ethylene-vinyl acetate (EVA) foam.

In an additional aspect, the molded foam body has a Shore D durometer ranging from approximately 40 to approximately 80.

In a further aspect, the molded foam body has a Shore D durometer ranging from approximately 55 to approximately 65.

In an additional aspect, the skate boot further comprises a back liner for facing a user'foot, the back liner being connected to the at least one exposed structural molded foam body.

In a further aspect, the tongue is releasably connected to at least one of the shell and the toe cap.

In an additional aspect, the skate boot further comprises a connector adapted to cooperate with at least one structure of at least one of the shell and the toe cap for releasably securing the tongue to the skate boot.

In a further aspect, the connector is one of integrally formed with the at least one exposed structural molded foam body, releasably connected to the at least one exposed structural molded foam body, and permanently connected to the at least one exposed structural molded foam body.

In an additional aspect, the connector is not connected to the at least one exposed structural molded foam body until the tongue is releasably secured to the skate boot.

In a further aspect, the toe cap has a top surface, the at least one structure of at least one of the shell and the toe cap is at least one aperture defined within the top surface of the toe cap, and the at least one aperture has at least one edge. The connector is adapted to pass through the at least one aperture of the top surface of the toe cap. At least a portion of the connector is adapted to fit in the at least one aperture of the top surface of the toe cap, and at least one portion of the connector is adapted to cooperate with the at least one edge of the at least one aperture of the top surface of the toe cap.

In an additional aspect, the at least one portion of the connector that is adapted to cooperate with the at least one edge of the at least one aperture of the top surface of the toe cap cooperates with the at least one edge of the at least one aperture of the top surface of the toe cap so as to releasably secure the tongue to the skate boot.

In a further aspect, the skate boot has a lace, and wherein the connector is adapted to receive a portion of the lace.

In an additional aspect, the plurality of apertures defined within the at least one exposed structural molded foam body are a first set of apertures, and the at least one exposed structural molded foam body further comprises at least one additional aperture defined within the at least one exposed structural molded foam body which is not part of the first set of apertures, the at least one additional aperture being adapted to receive at least a portion of the connector so as to releasably secure the tongue to the toe cap.

For purposes of this application, terms used to locate elements on skate boot or their spatial orientation, such as "forwardly", "rearwardly", "front", "back", "rear", "left", "right", "up", "down", "above", and "below", are as they would normally be understood by a person normally wearing the skate boot.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present embodiment is described with respect to a skate boot for an ice skate, however it is contemplated that in other embodiments the skate boot may be for other type of skates having different types of ground-engaging elements. For example, in an embodiment, the skate boot is a skate boot for a roller skate having a wheel holder and a set of wheels as the ground-engaging element.

Figure 1:
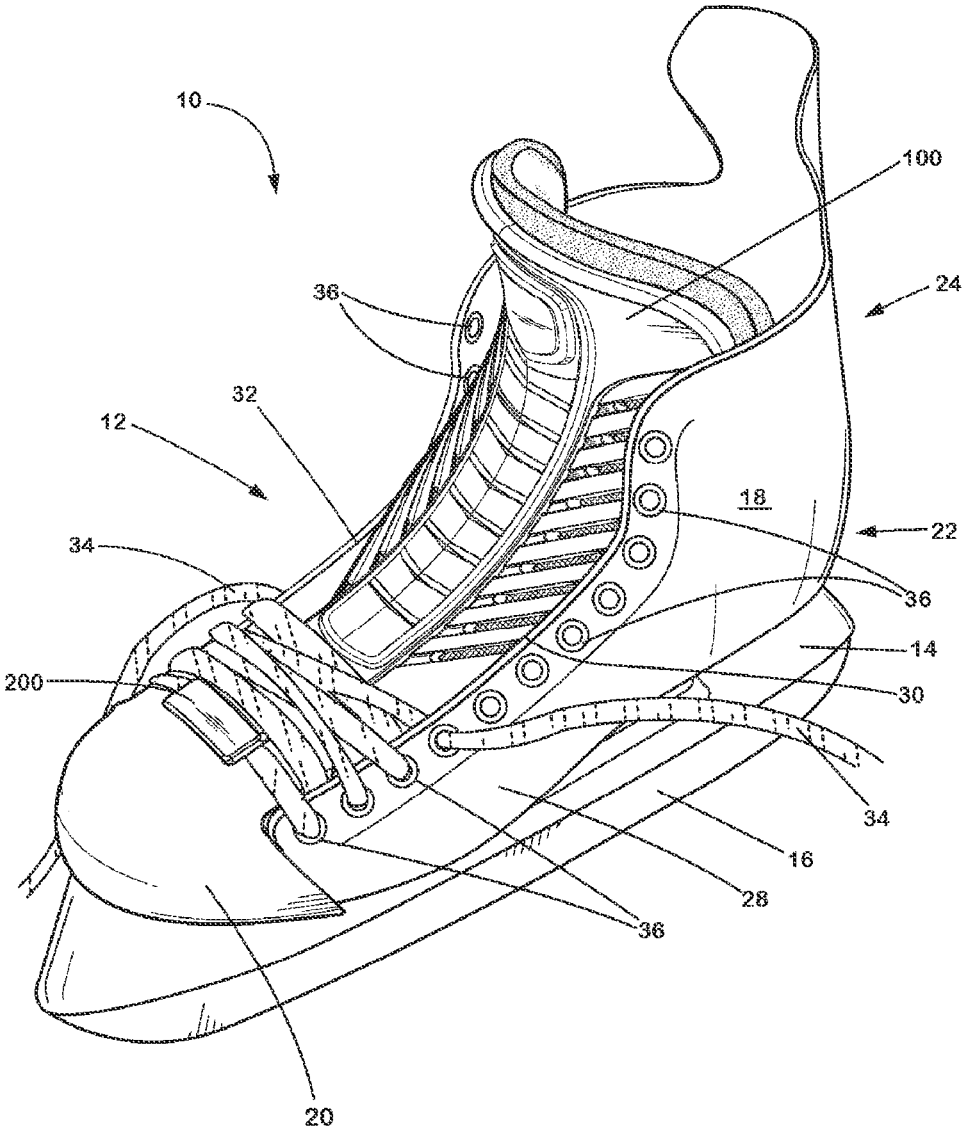
FIG. 1 is a perspective view, taken from a front, left side, of an ice skate according to a first embodiment.
Figure 19:
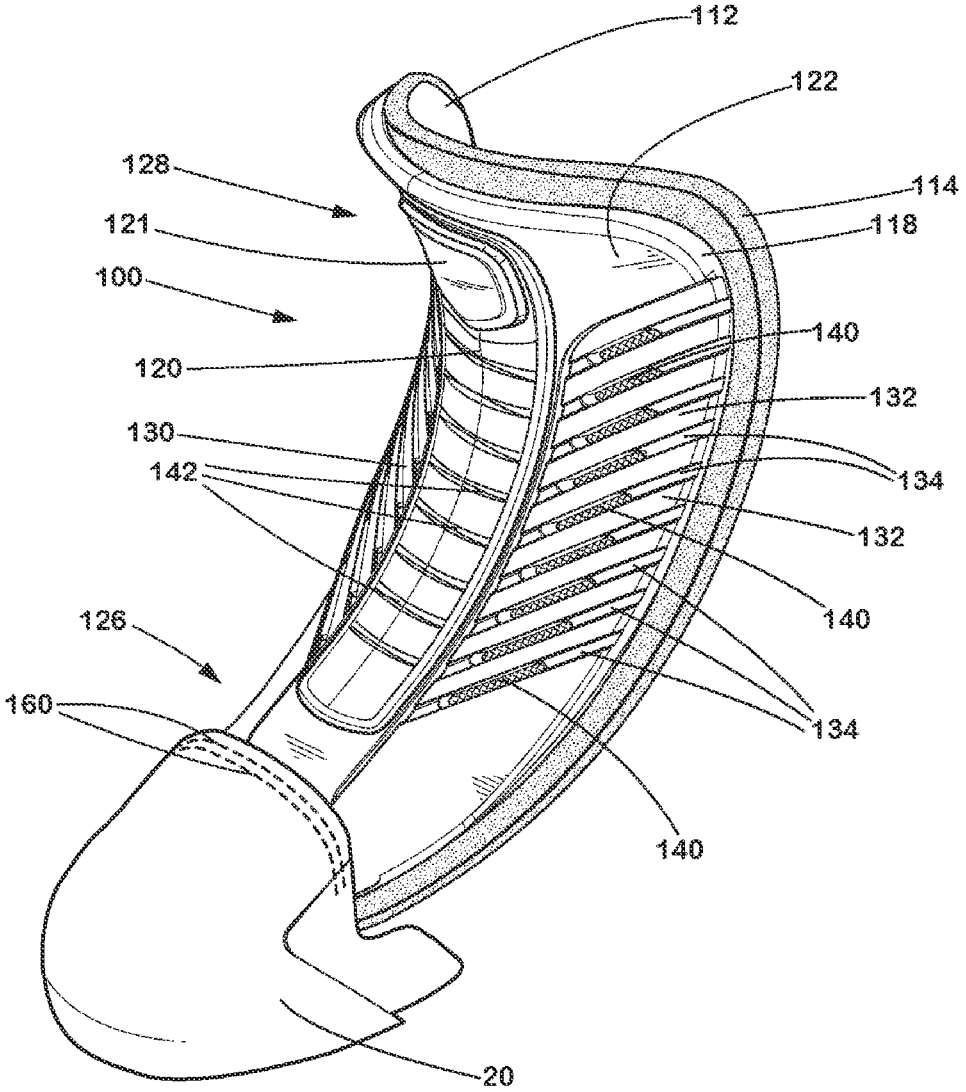
FIG. 19 is a perspective view, taken from a front, left side, of a tongue and toe cap assembly according to another embodiment.

As shown in FIG. 1, a skate 10 has a skate boot 12, a blade holder 14 connected to the bottom of the skate boot 12, and a blade 16 disposed in the blade holder 14. The skate boot 12 includes a shell 18, a toe cap 20 connected to the shell 12, and a tongue 100. In this embodiment, the tongue 100 is releasably connected to the toe cap 20 as described in greater detail below. However, it is contemplated that in other embodiments, the tongue 100 can be permanently connected to the toe cap 20. In the embodiment shown in FIG. 19, the tongue 100 is stitched to the toe cap 20. It is also contemplated (but not required) that the toe cap 20 could be integrally formed with the shell 18. Blade holders 14 and blades 16 are known in the art, and as such will not be described in further detail herein.

The shell 18 is shaped to enclose the heel, the upper and lower parts of the Achilles tendon, and the medial and lateral surfaces of the foot of a wearer of the skate 10 (foot not shown). As such, the shell 18 comprises a heel counter 22 for enclosing the heel, an ankle portion 24 receiving the ankle, and medial quarter (not shown) and lateral quarter 28 facing the respective medial and lateral sides of the foot. The medial and lateral quarters 26, 28 extend forwardly from the heel counter 22. It is contemplated that the shell 18 could be formed of a single integral piece, or could be made of multiple pieces that are connected together to form the overall shape of the shell 18. It is also contemplated that the shell 18 could be formed of foam, plastic, leather, or any other suitable material or combination of materials.

The tongue 100 is adapted to fit between the sides 30 and 32 of the shell 18, such that the tongue 100 covers the forefoot and the front ankle portion. The skate boot 12 includes a lace 34 (shown partially laced in FIG. 1) that extends through lace eyelets 36 in the sides 30, 32 of the shell 18 in a criss-crossing pattern. As such, when the lace 34 is tightened, the lace 34 acts to keep the tongue 100 in place.

Figure 2:
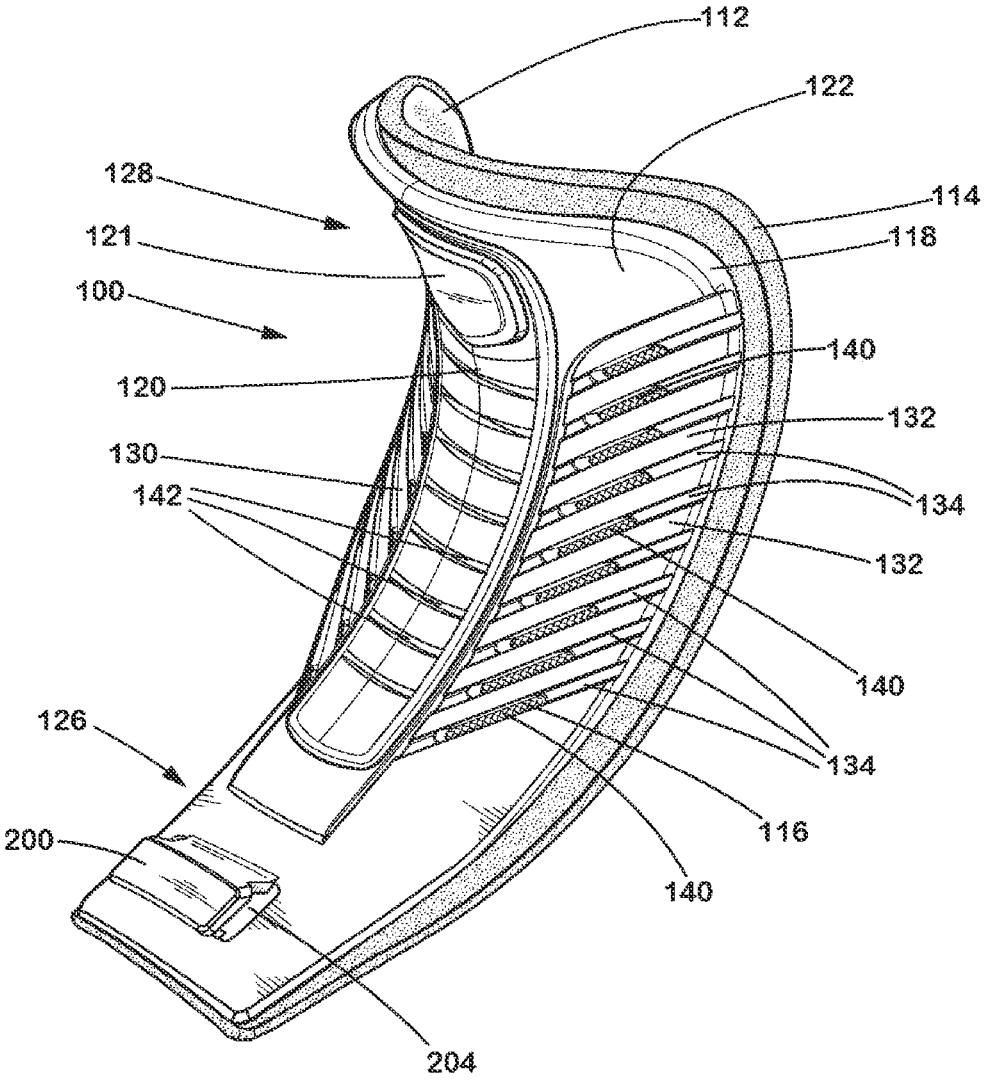
FIG. 2 is a perspective view, taken from a front, left side, of the tongue of the ice skate of FIG. 1.
Figure 3:
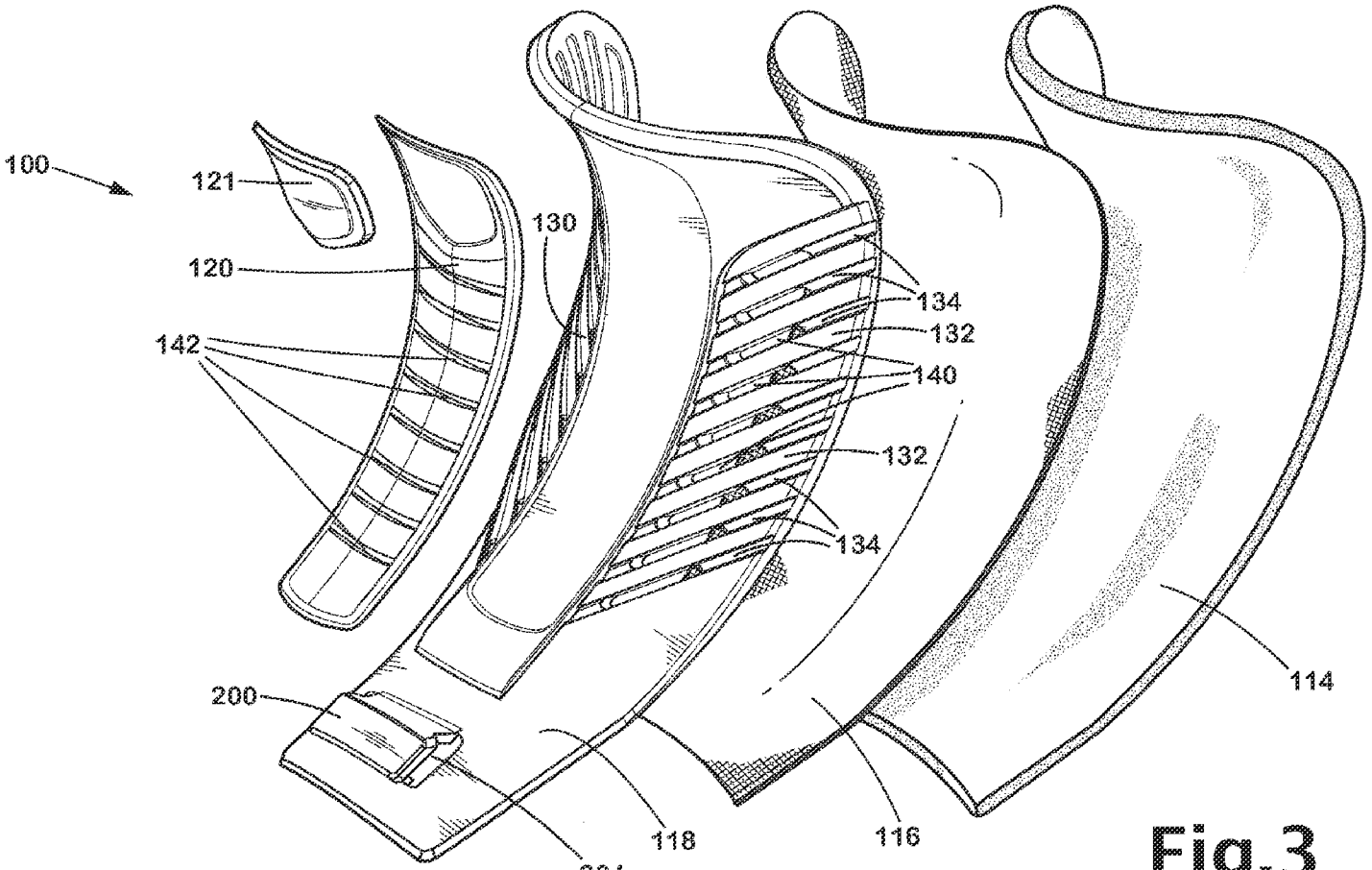
FIG. 3 is an exploded view of the tongue of FIG. 2.

As shown in FIGS. 2 and 3, the tongue 100 of the skate boot 12 has an inner side 112 facing the forefoot and the front ankle portion of a wearer foot (not shown). The tongue 100 comprises a back liner 114, a contrast layer 116 (shown through apertures 140 in FIG. 2), a molded foam body 118, a tongue cover 120 and a decorative element 121. The back liner 114, contrast layer 116, molded foam body 118, and tongue cover 120 are stitched together (stitches not shown). However, it is contemplated that the back liner 114, contrast layer 116, molded foam body 118, tongue cover 120 and decorative element 121, can be glued or laminated to each other, or connected to each other by any other suitable means. It is also contemplated that some of the back liner 114, contrast layer 116, molded foam body 118, tongue cover 120 and decorative element 121 can be stitched together while the others of the back liner 114, contrast layer 116, molded foam body 118, tongue cover 120 and decorative element 121, can be glued, laminated or otherwise connected to each other by any other suitable means.

The back liner 114 is the inner most portion of the tongue 100 and its inner side is the inner side 112 of the tongue 100. It is contemplated that the back liner 114 can be made of a piece of felt such as, for example, polyester felt, or other fabric. In the embodiment shown in FIG. 2, the back liner 114 is made of a polyester felt. It is also contemplated that in different embodiments, the back liner 114 can be approximately 1 millimeter (mm) to about 10 mm thick such as, for example, approximately 3 mm to approximately 7 mm or approximately 5 mm thick, as in the embodiment shown in FIG. 2. It is contemplated that in some embodiments, the back liner 114 is a felt fabric that is thinner than conventional felt tongue liners. It is also contemplated that in other embodiments, the back liner 114 can be made of any soft material, preferably a soft synthetic material. For example, in an alternate embodiment, the back liner 114 is made of nylex fabric. It is also contemplated that in other embodiments, the back liner 114 can be made of foam, such as an ethylene-vinyl acetate (EVA) foam. Such a foam back liner can be made by, for example, molding by compression, injection, or expansion, or by cutting of foam such as die cutting. It is contemplated that in some embodiments, a foam back liner can have a lower density or hardness than the molded foam body 118. In some embodiments, a foam back liner can have a Shore A durometer of less than about 60, such as between approximately 40 and approximately 60. It is also contemplated that in other embodiments, the tongue 100 can be provided without any back liner such as the back liner 114.

The contrast layer 116 is sandwiched between the back liner 114 and the molded foam body 118. The contrast layer 116 is made of a contrasting color piece of polyester mesh. It is contemplated that in other embodiments, the contrast layer 116 can be made of any fabric or mesh fabric, foam, foil, paper or other material. In some embodiments, the contrast layer 116 can be made of perforated foam such as perforated EVA foam or nylon or any other suitable fabric allowing air to pass through and preferably of a contrasting color with the molded foam body 118. It is contemplated that in an alternate embodiment in which the tongue 100 would not have a back liner 114, the contrast layer 116 would be the innermost portion of the tongue 100 and its inner side would be the inner side 112 of the tongue 100. It is also contemplated that in other embodiments, the tongue 100 can be provided without a contrast layer such as the contrast layer 116.

The molded foam body 118 is the main structural body of the tongue 100 and, as shown in FIGS. 1, 2 and 3, not only is the molded foam body 118 exposed, but it is the most visible portion of the tongue 100. In this embodiment, the molded foam body 118 is made of expanded EVA. However, it is contemplated that in various embodiments, the molded foam body 118 can be made by any suitable foam molding technique such as, for example, by compression molding, injection molding, and expansion molding, and that any other suitable foam (e.g., polyurethane (PU) based foam) may be used. It is also contemplated that in different embodiments, the molded foam body 118 may have different thickness and that in a single embodiment, different portions of the molded foam body 118 may have different thickness. In the embodiments shown in the Figures the thickness of the molded foam body 118 varies but the molded foam body 118 has a maximum thickness of at least approximately 4 mm to at least approximately 6 mm such as at least approximately 5 mm, at least approximately 6 mm, or at least approximately 8 mm. For instance, the molded foam body 118 has a thickness of approximately 5 mm to approximately 9 mm in most of its portions, but tapers to less than 5 mm at its edges.

In the embodiment shown in FIGS. 1, 2 and 3, the molded foam body 118 has a Shore D durometer of approximately 60. However, it is contemplated that the molded foam body 118 may have a Shore D durometer ranging from approximately 40 to approximately 80, more preferably from approximately 55 to approximately 65. It is also contemplated that the molded foam body 118 may have various portions each of which may have a different thickness, density, and/or hardness so as to be adapted to a skater's specific needs. It is also contemplated that the molded foam body 118 may be made of more than layer of molded foam, each layer being made of a foam having a different thickness, density and/or hardness. In some embodiments, the outermost layer of the molded foam body 118 has a higher density and/or harness than the innermost layer. In some instances, layers of the molded foam body 118 are progressively less hard and/or less dense from the outermost layer to the innermost layer. In some embodiments, the back liner 114 is made of a foam material and has a density and/or hardness that is less than that of the molded foam body 118 or of the innermost layer of the molded foam body 118.

It is contemplated that the molded foam body 118 can be easily manufactured and provided to customers in a wide range of shapes, sizes, hardness, density and density patterns so as to be specifically adapted to different skaters' needs. Molded foam body 118 may also easily be manufactured and provided to customers with a wide range of particular designs (e.g., stitchless molded-in designs) applied thereto, making the overall tongue 100 more aesthetically interesting. Finally, molded foam can be lightweight and relatively inexpensive to manufacture, so having a molded foam body 118 as one of the main structural part of the tongue 100 can participate in providing a lighter and less expensive tongue 100.

Figure 4:
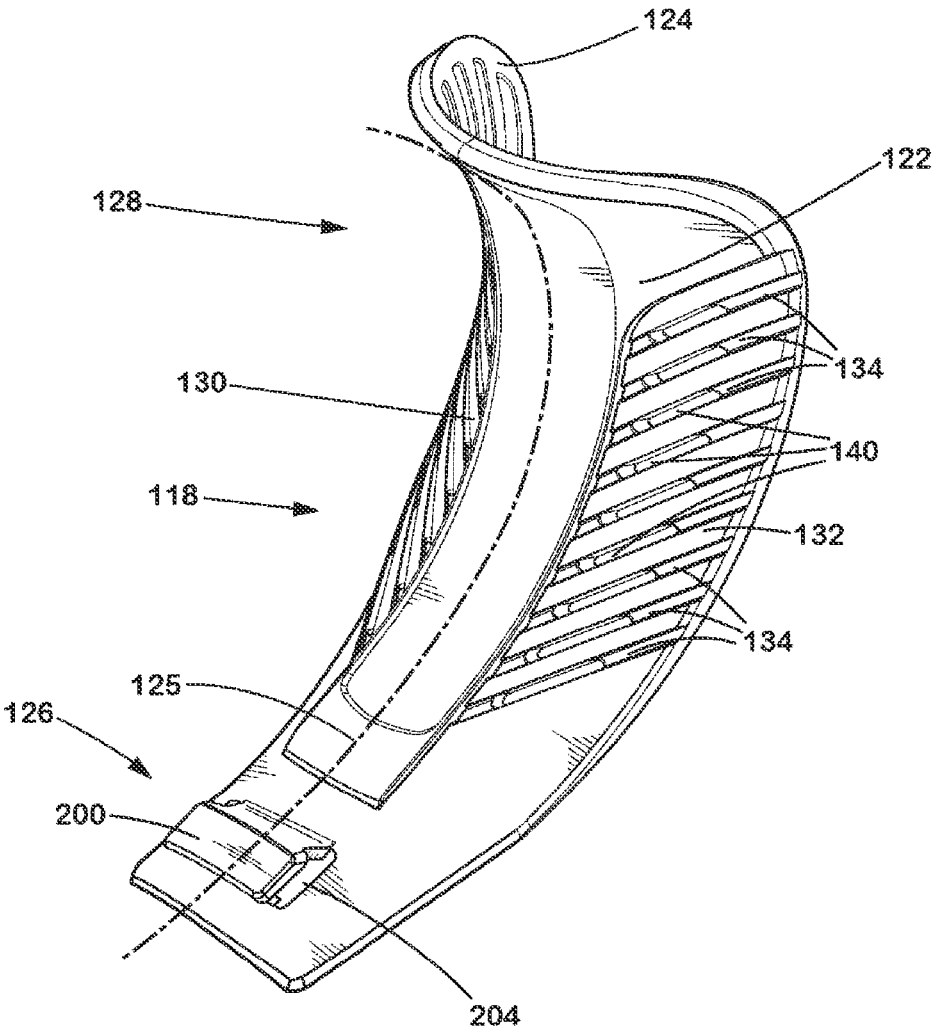
FIG. 4 is a perspective view, taken from a front, left side, of the molded foam body of the tongue of FIG. 2.
Figure 5:
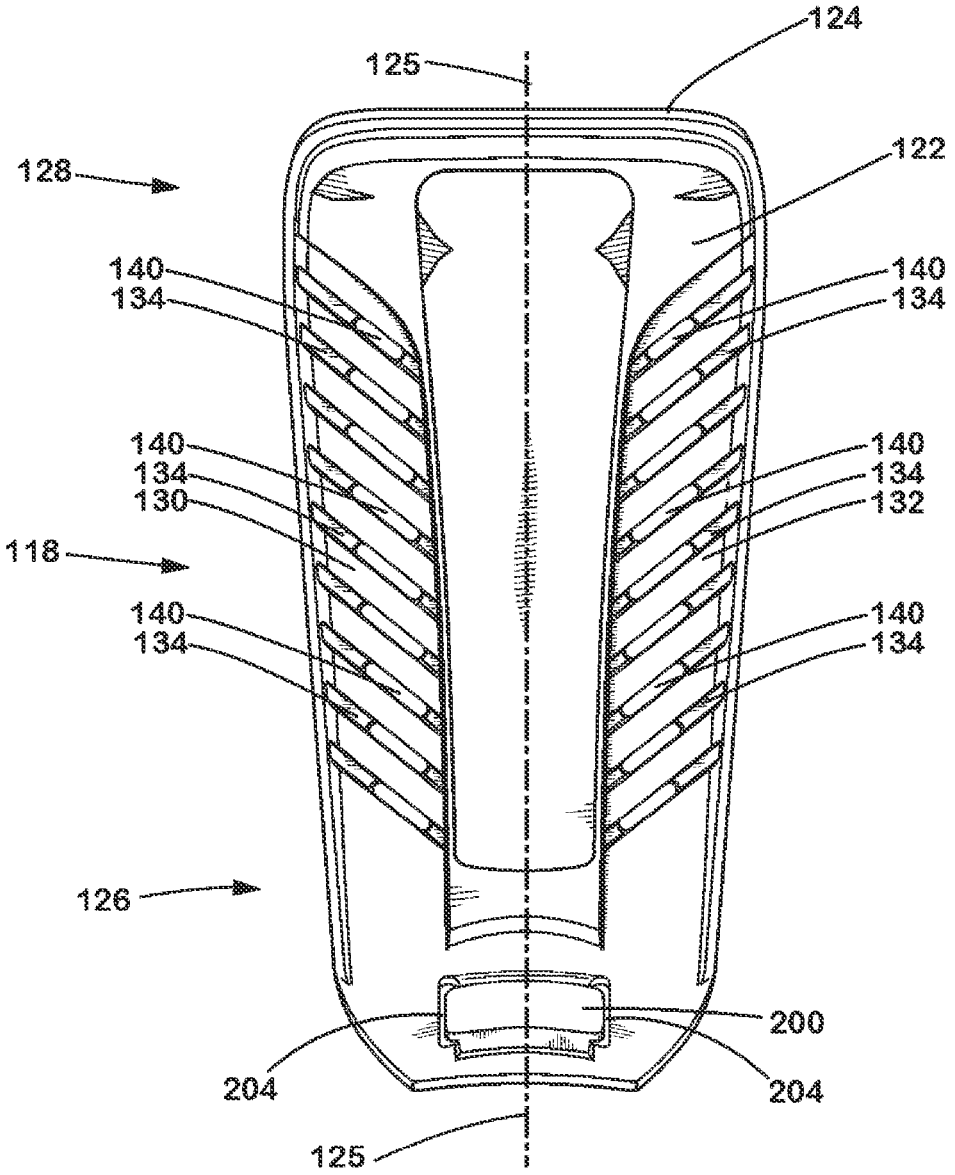
FIG. 5 is a front elevation view of the molded foam body of FIG. 4.

As shown in FIGS. 4 and 5, the molded foam body 118 defines a longitudinal axis 125 and has an outer side 122, an inner side 124, a first end 126, a second end 128 and lateral portions 130, 132.

A plurality of grooves 134 are defined in the outer side 122 of the molded foam body 118, on both sides of and along the longitudinal axis 125. In this embodiment, the grooves 134 extend generally at an angle to the longitudinal axis 125. As shown in FIGS. 4 and 5, grooves 134 extend generally at an acute angle to the longitudinal axis 125. However, it is contemplated that in other embodiments, grooves 134 can extend generally at an obtuse or right angle to the longitudinal axis 125. The grooves 134 can provide improved forward flexibility to the whole molded foam body 118. The grooves 134 also can provide improved overall flexibility to the lateral portions 130, 132 of the molded foam body 118. The grooves 134 also can make the molded foam body 118 easier to fit to the particular morphology of various types of skaters' feet and can allow for more adapted localised flexibility and support and improved comfort. It is also contemplated that in other embodiments, all grooves 134 or some of them may also extend generally parallel to the longitudinal axis 126 or in other suitable orientation, and have different shapes or lengths, or not be grooves but simply recesses of various shapes and sizes, so as to provide either improved localised flexibility or support, or both to the molded foam body 118.

Figure 6:
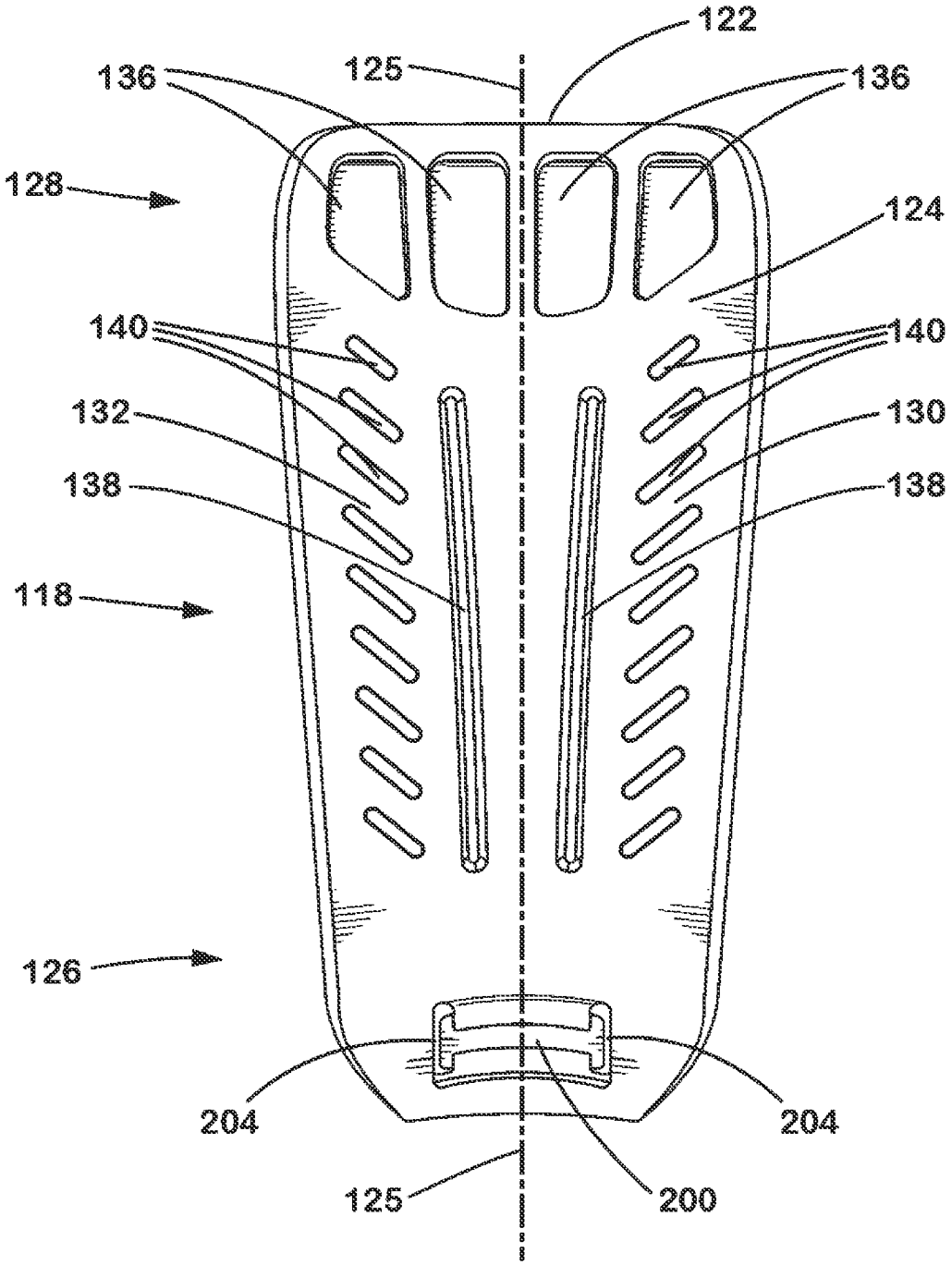
FIG. 6 is rear elevation view of the molded foam body of FIG. 4.
Figure 7:
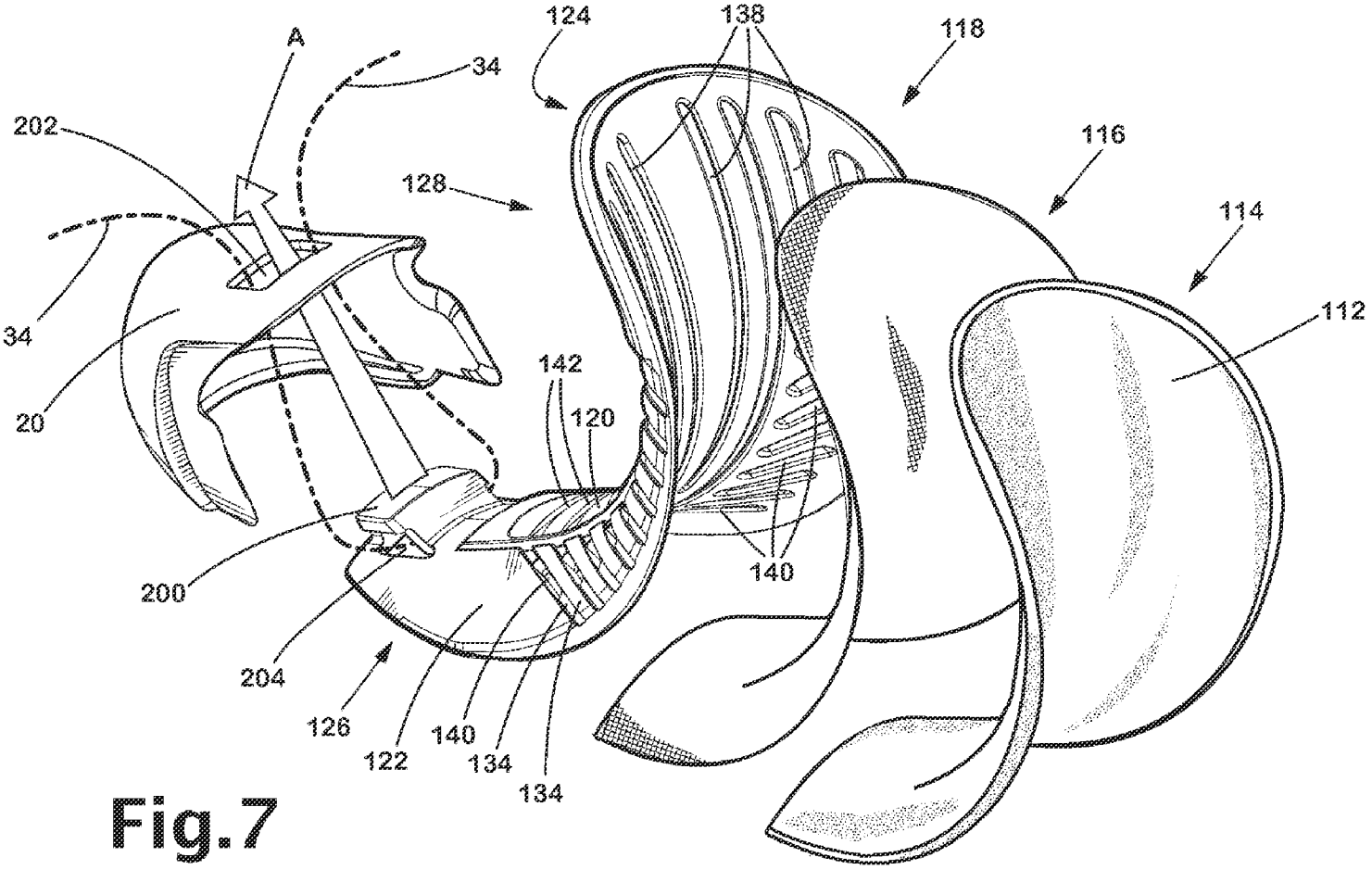
FIG. 7 is an perspective exploded view, taken from a rear, left side, of the tongue of FIG. 2 with the toe cap of the ice skate of FIG. 1.
Figure 8:
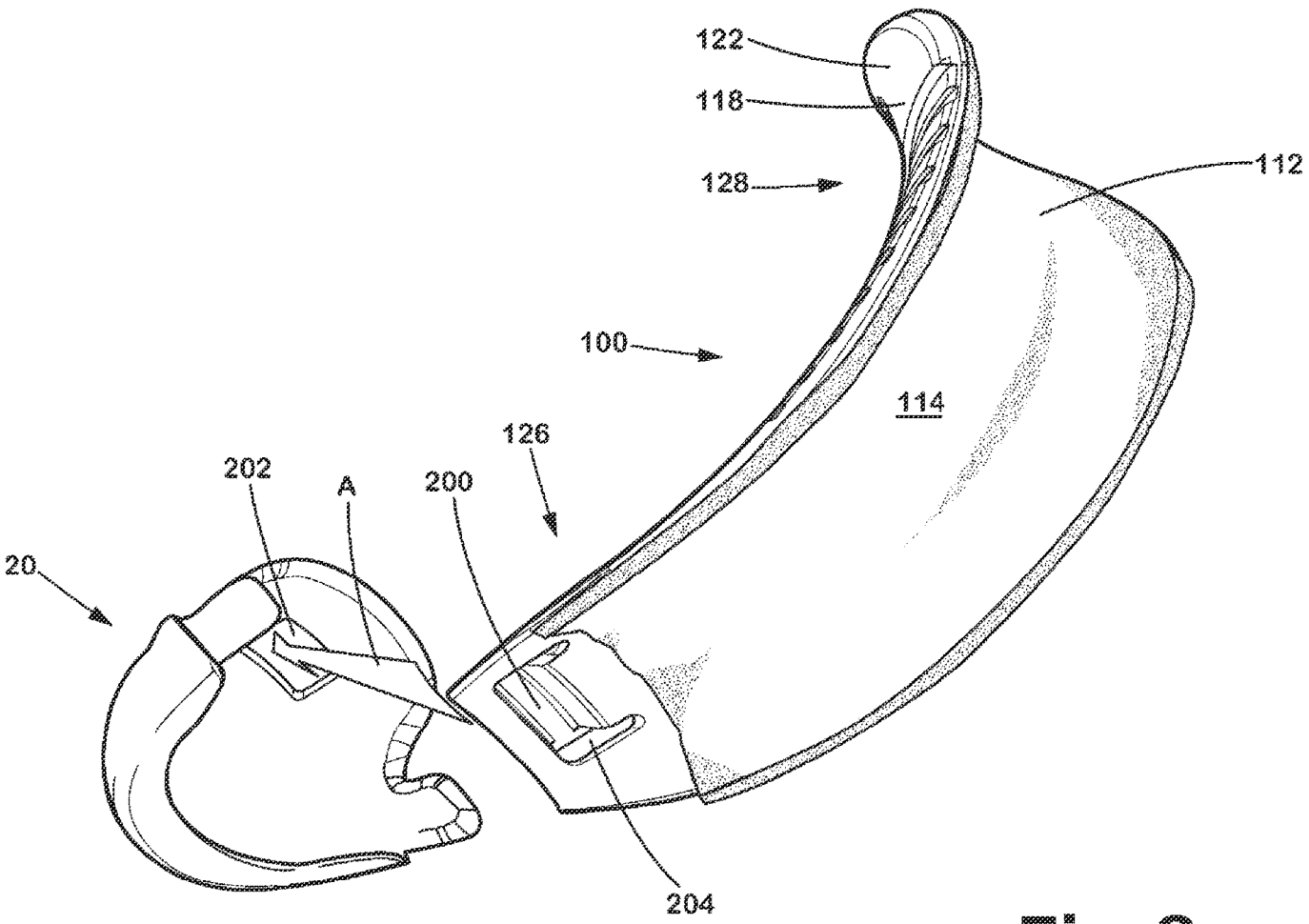
FIG. 8 is a perspective view, taken from a bottom, rear and left side, of the tongue and toe cap of FIG. 7 with a portion of the back liner removed for a better understanding of the underlying structure.

As shown in FIG. 6, a plurality of recesses 136 and grooves 138 are also defined in the inner side 124 of the molded foam body 118. The recesses 136 are defined in the first end 126 of the molded foam body 118 (inner side 124) and the grooves 138 extend generally parallel to the longitudinal axis 126. As for grooves 134, the recesses 136 and grooves 138 can assist in providing a molded foam body 118 having improved adapted and localised flexibility and support as well as being more comfortable. It is also contemplated that in other embodiments, the recesses 136 and grooves 138 may be oriented or shaped differently and may be defined elsewhere in the inner side 124 of the molded foam body 118. FIG. 7 shows such an alternative embodiment.

It is also contemplated that in another embodiment, the molded foam body 118 may be provided with only grooves such as grooves 134 and recesses defined in the outer side 122 and no grooves and recesses such as grooves 138 and recesses 136 defined in the inner side 124. Conversely, in another embodiment, the molded foam body 118 may be provided with only recesses and grooves such as the recesses 136 and grooves 138 defined in the inner side 124 and no grooves and recesses such as grooves 134 defined in the outer side. It is also contemplated that in yet another embodiment, the molded foam body 118 may be provided without any grooves or recesses defined therein.

Grooves 134, recesses 136 and grooves 138 also participate m providing a lighter and potentially less expensive molded foam body 118.

A plurality of apertures 140 are also defined in the molded foam body 118. In this embodiment, the apertures 140 have generally elongated shapes, and extend generally at an acute angle to the longitudinal axis 125. In this embodiment, the apertures 140 are disposed within the grooves 134, and are approximately 15 mm to approximately 17 mm long, approximately 3 to approximately 4 mm wide, and approximately 4 to approximately 5 mm deep.

However, it is contemplated that in other embodiments, the apertures 140 may have various shapes and sizes, and be defined anywhere in the molded foam body 118, including outside the grooves 134, which would necessarily be the case in embodiments not having grooves such as the grooves 134. It is therefore contemplated that in other embodiments, apertures 140 can extend generally at an obtuse or right angle to the longitudinal axis 125. Furthermore, it is contemplated that apertures 140 can be formed in the molded foam body 118 when the foam is molded or may be cut or punched into the molded foam body 118 after it is molded.

It is also contemplated that in an embodiment (not shown), the apertures 140 can be fluidly connected to the recesses 136 and/or grooves 138 defined in the inner side 124 of the molded foam body 118 so the recesses 136 and/or grooves 138 can act as air channels allowing air to circulate along the back of the molded foam body 118 and tongue 100 and in and out of the apertures 140.

The apertures 140 can have essentially the same functions as the grooves 134, recesses 136 and grooves 138. However, they can also allow air to pass through the molded foam body 118 and can thereby allow moisture to pass through the tongue 100 and exit the skate boot 12 and fresh air to enter the skate boot 12. Furthermore, the contrast layer 116 shows through the apertures 140, providing a particular aesthetic signature to the tongue 100.

When the molded foam body 118 is connected to the back liner 114, the edges of the apertures 140 are not stitched to the back liner 114. It is contemplated that the molded foam body 118 can be connected to back liner 114 using an adhesive, and that since the apertures 140 are defined in the molded foam body 118 rather than being defined within a stitched outer shell such as a leather shell, there is no need to stitch around the apertures 140.

The tongue cover 120 can be used both as a tongue stiffener providing additional structural rigidity to the tongue 100, and as the tongue's 100 lacebite distributing the pressure applied by the lace 34 on the tongue 100 and the skater's forefoot when the skate is in use. In this embodiment, the tongue cover 120 is made of approximately 6 mm to approximately 8 mm compressed polyethylene (PE) foam covered by nylon fabric. It is contemplated that in various embodiments, the tongue cover 120 can include of one or more layers of molded foam, such as EVA or other high density compressed foam, and one or more fabric layers, or various combinations thereof. It is contemplated that the tongue cover 120 can be approximately 1 mm to approximately 5 mm thick. As shown in FIG. 3, the tongue cover 120 has a plurality of ribs 142 defined therein to provide improved localised support and flexibility and/or additional lacing stability.

The decorative element 121 is a skate jewel. It is contemplated that in other embodiments, the decorative element 121 may be made from plastic, foam or any other suitable material and comprise a logo or any type of decorative or ornamental element.

In the embodiment shown in FIGS. 2, 3, 4 and 7 to 11, the molded foam body 118 has a connector 200 integrally formed therewith. The connector 200 extends outwardly from the outer side 122 of the molded foam body 118 and is disposed in the first end 126 thereof. The connector 200 is adapted to pass through (see arrow "A" in FIGS. 7 and 8, a portion of the back liner 114 having been removed to show the underlying structure) and fit in an aperture 202 defined within the toe cap 20 to releasably connect the molded foam body 118 to the toe cap 20, thereby releasably connecting the tongue 100 to the skate boot 12. It can be seen that the connector has opposed ends, with one of the opposed end connected to the tongue and the other of the opposed ends spaced from the tongue.

Figure 9:
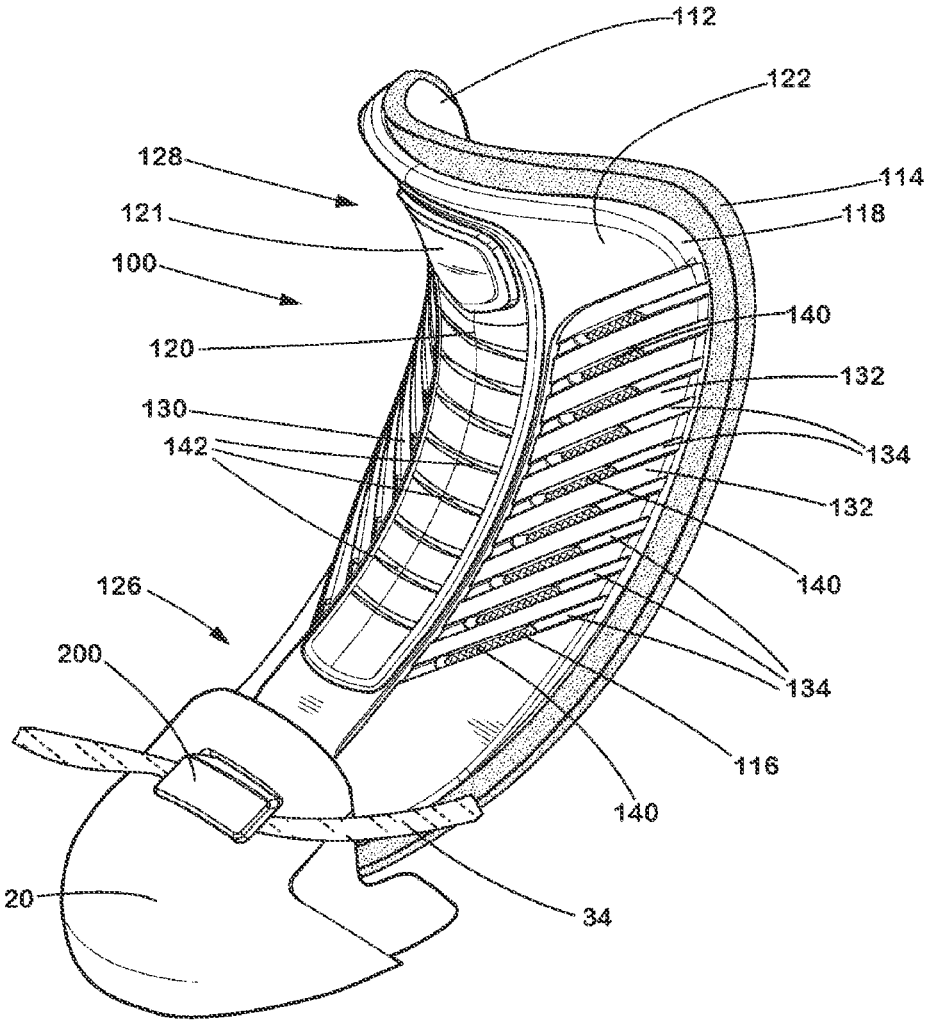
FIG. 9 is a perspective view, taken from a front, left side, of the tongue and toe cap of FIG. 7 when they are assembled.
Figure 10:
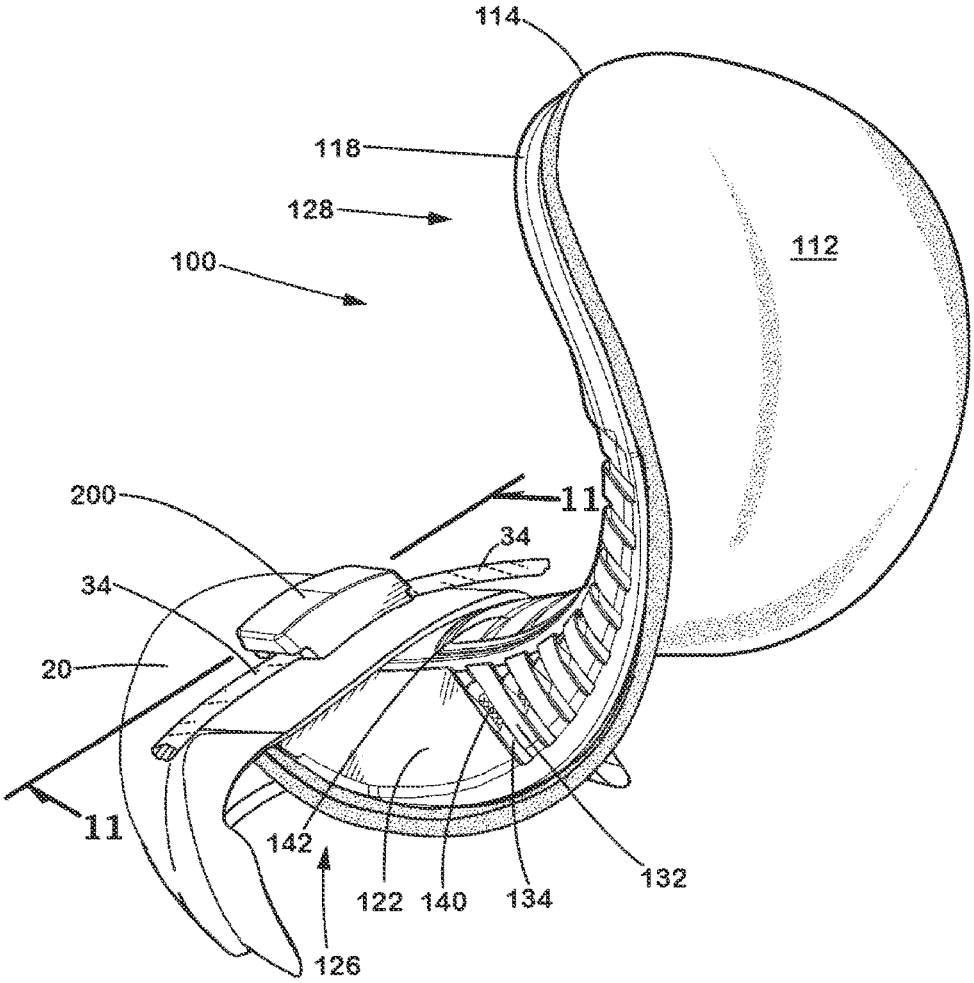
FIG. 10 is a perspective view, taken from a rear, left side, of the tongue and toe cap assembly of FIG. 7.
Figure 11:
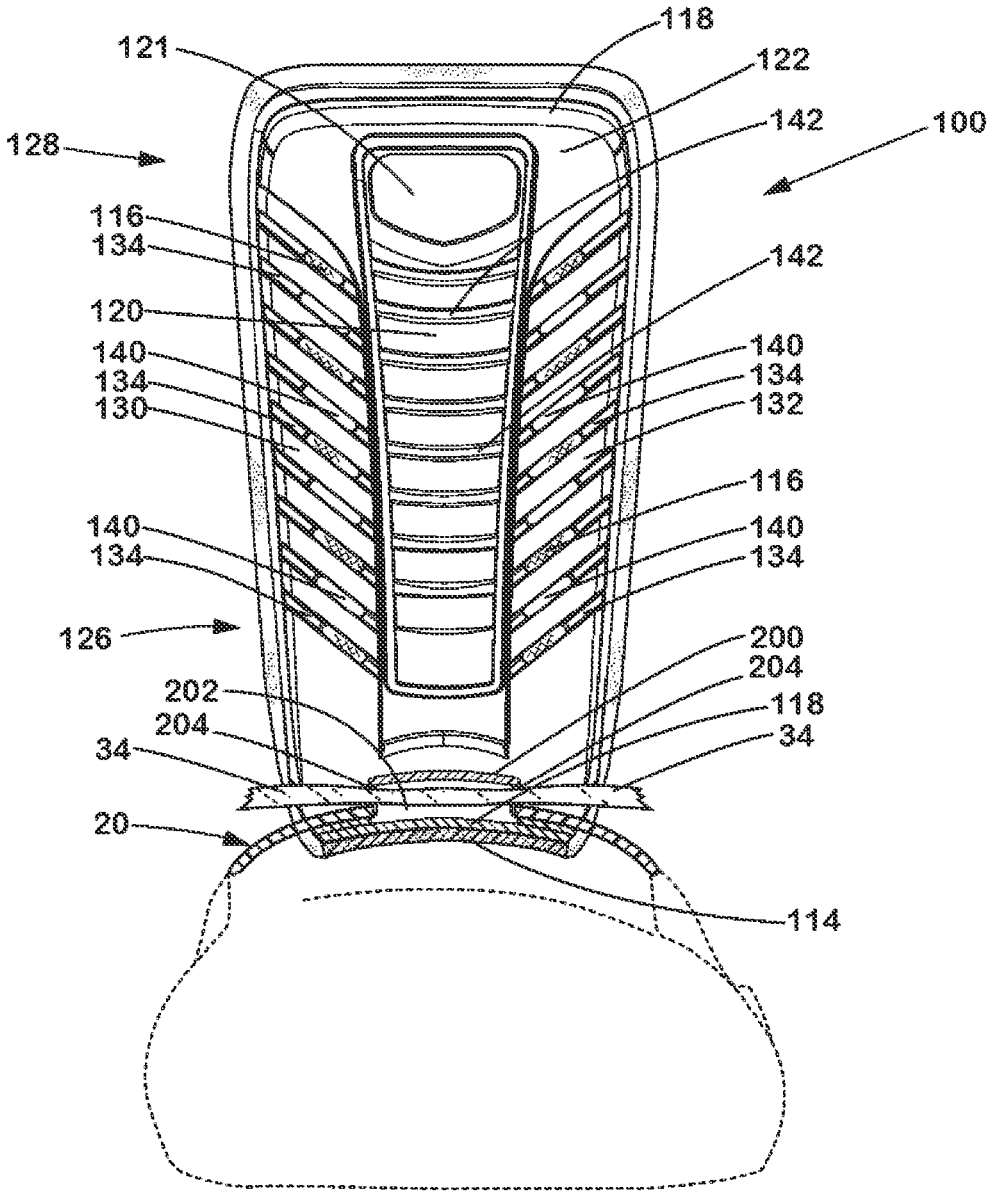
FIG. 11 is a transverse cross-sectional view of a portion of the tongue and toe cap assembly of FIG. 7 taken along line 11-11 in FIG. 10.

The connector 200 also has an aperture 204 defined therein for receiving a portion of the lace 34 (represented by a broken line in FIG. 7) to more tightly secure the molded foam body 118 to the toe cap 20 (see FIGS. 9, 10 and 11). However, it is contemplated that in other embodiments, the connector 200 does not have an aperture such as the aperture 204 defined therein for receiving a portion of the lace 34.

Figure 12:
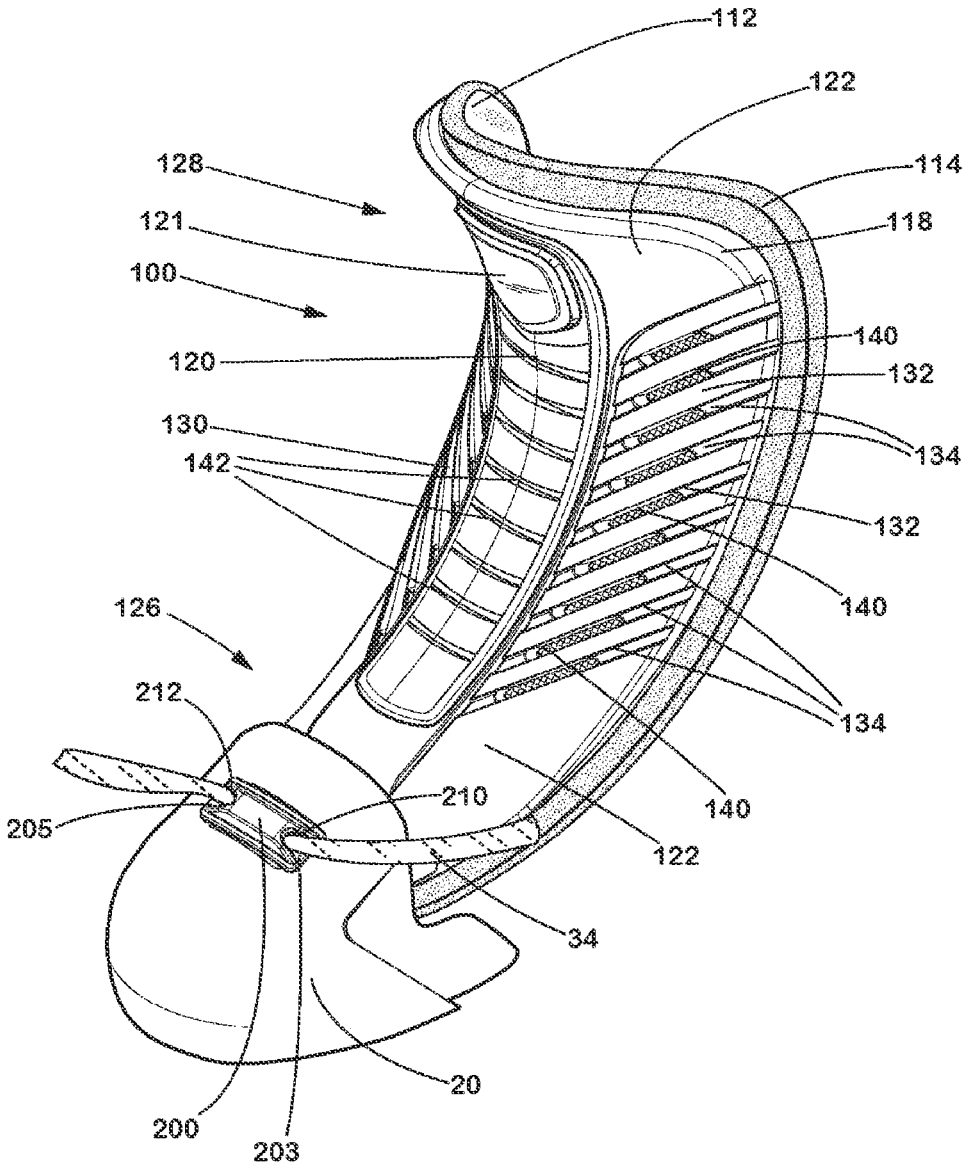
FIG. 12 is a perspective view, taken from a front, left side, of a tongue, toe cap and connector assembly according to another embodiment.
Figure 13A:
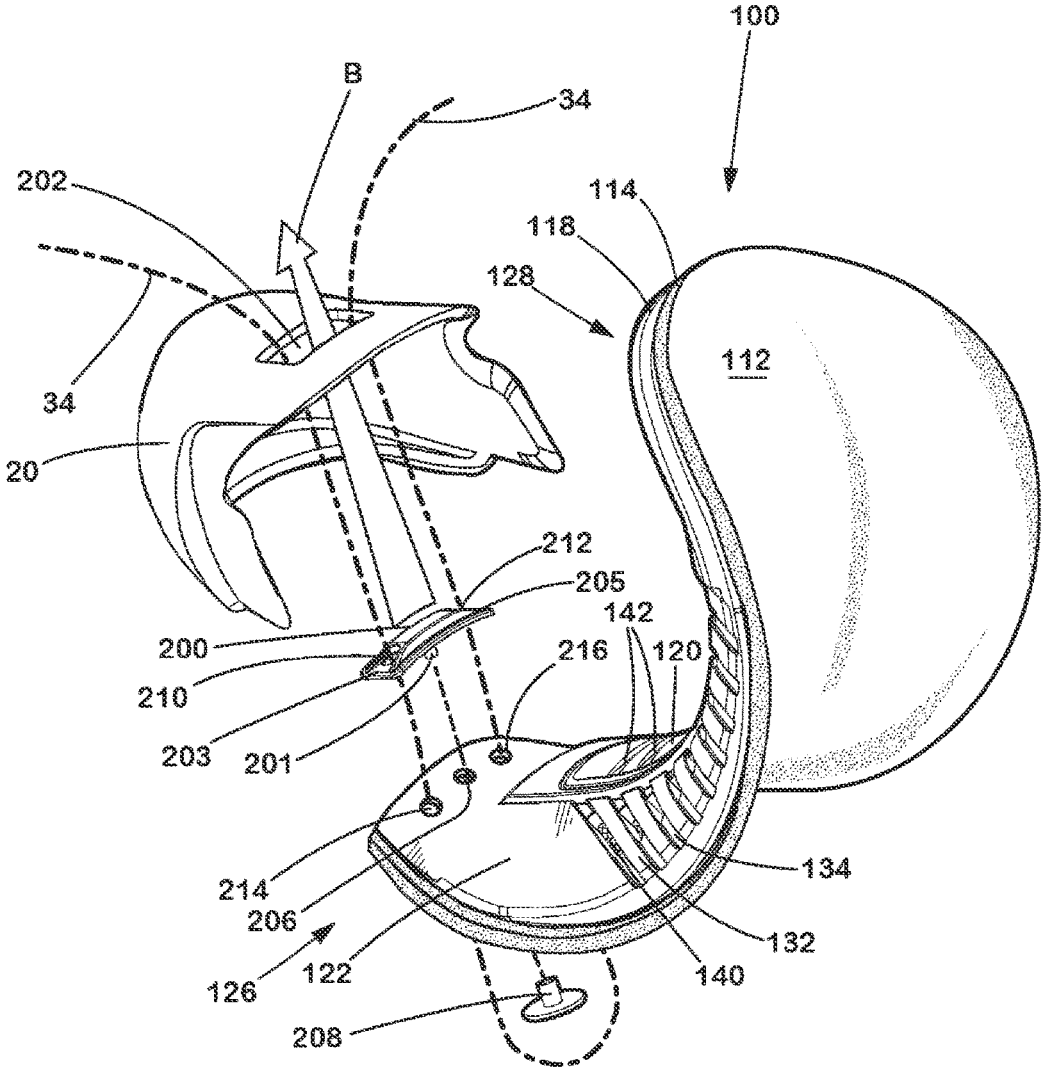
FIG. 13A is a perspective view, taken from a rear, left side, of the tongue, toe cap and connector assembly of FIG. 12 with the tongue, toe cap and connector shown as distinct parts before they are assembled.
Figure 13B:
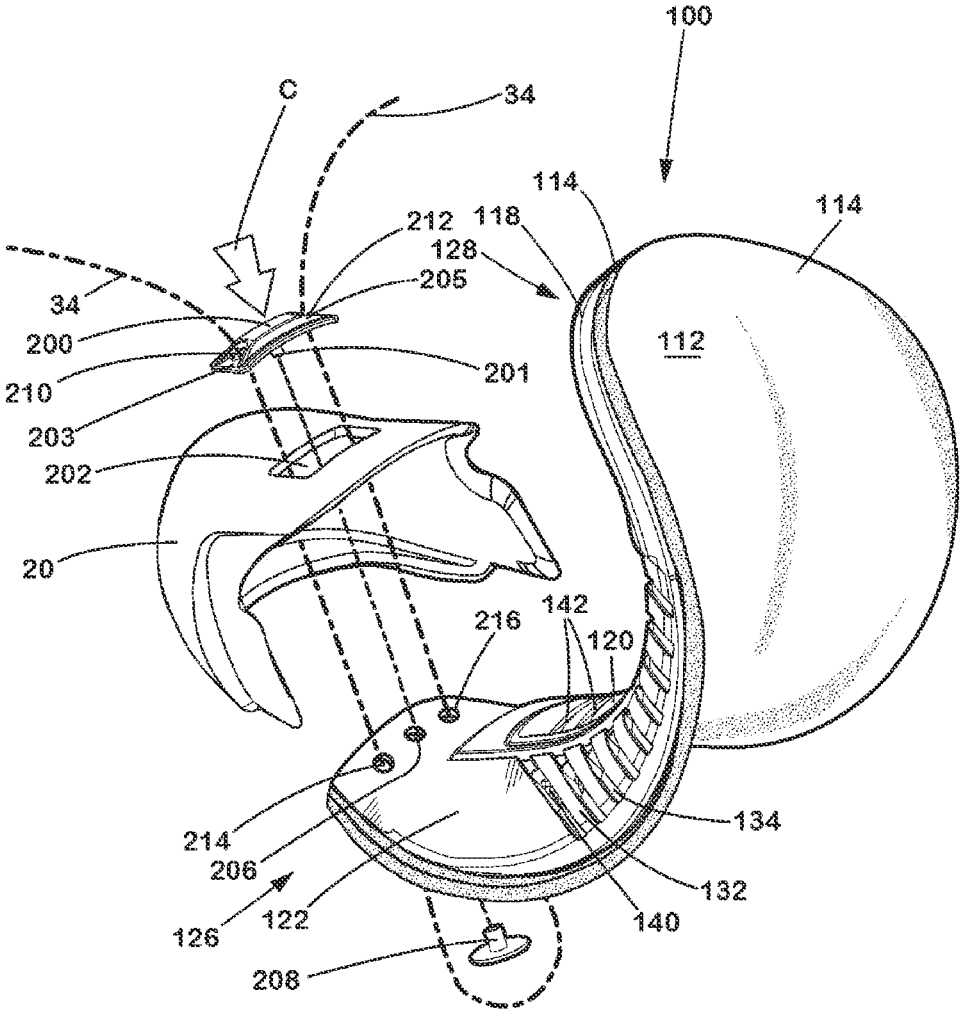
FIG. 13B is a perspective view, taken from a rear, left side, of a tongue, toe cap and connector according to another embodiment before they are assembled.
Figure 14:
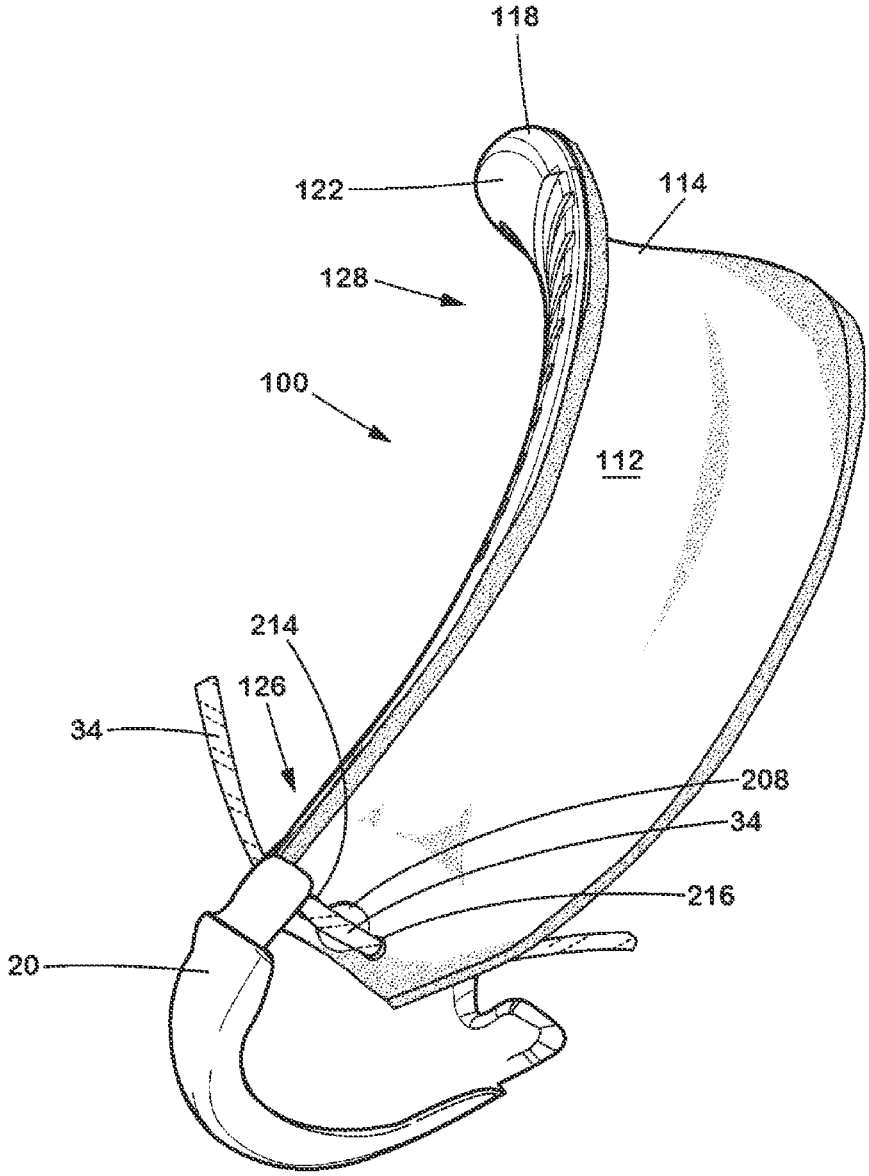
FIG. 14 is a perspective view, taken from a bottom, rear and left side, of the tongue, toe cap and connector assembly of FIG. 12.

In another embodiment shown in FIGS. 12, 13 and 14, the connector 200 is not integrally formed with the molded foam body 118. It can be seen that the connector has opposed ends, with one of the opposed end connected to the tongue and the other of the opposed ends spaced from the tongue. The connector 200 is adapted to pass through (see arrow "B" in FIG. 13A) and fit in the aperture 202 defined within the toe cap 20. In this embodiment, the lateral portions 203, 205 of the connector 200 cooperate with the edges of the aperture 202 to snap the connector 200 to the toe cap 20. A protrusion 201 extends from the connector 200 and is adapted to pass through and fit in an aperture 206 defined within the first end 126 of the molded foam body 118. An element 208 is adapted to cooperate with the protrusion 201 to releasablyg secure the connector 200 to the molded foam body 118, thereby releasably securing the tongue 100 to the toe cap 20 (and to the skate boot 12). In this embodiment, the tongue 100 and toe cap 20 can be releasably secured to each other in two steps: first the connector 200 is releasably secured to the tongue 100 using the element 208 once the protrusion 201 has been passed through the aperture 206, then the connector 200 is snapped in the aperture 202. It is also contemplated that in another embodiment shown in FIG. 13B, the two steps for securing the tongue 100 to the toe cap 20 can be as follows: first the connector 200 is fitted into the aperture 202 from the outer surface of the toe cap 20 (see arrow "C" in FIG. 13B), and then the protrusion 201 is introduced in the aperture 206 and the element 208 is used to releasably secure the tongue 100 to the connector 200 and toe cap 20.

Apertures 210, 212 defined within the connector 200 are aligned with apertures 214, 216 defined within the molded foam body 118 to allow a portion of the lace 34 (represented by broken lines in FIG. 13) to pass through the connector 200 and molded foam body 118 to more tightly secure the molded foam body 118 to the toe cap 20. However, it is contemplated that in other embodiments, the connector 200 and/or molded foam body 118 do not have apertures such as the apertures 210, 212, 214, 216 defined therein for receiving a portion of the lace 34.

Figure 15:
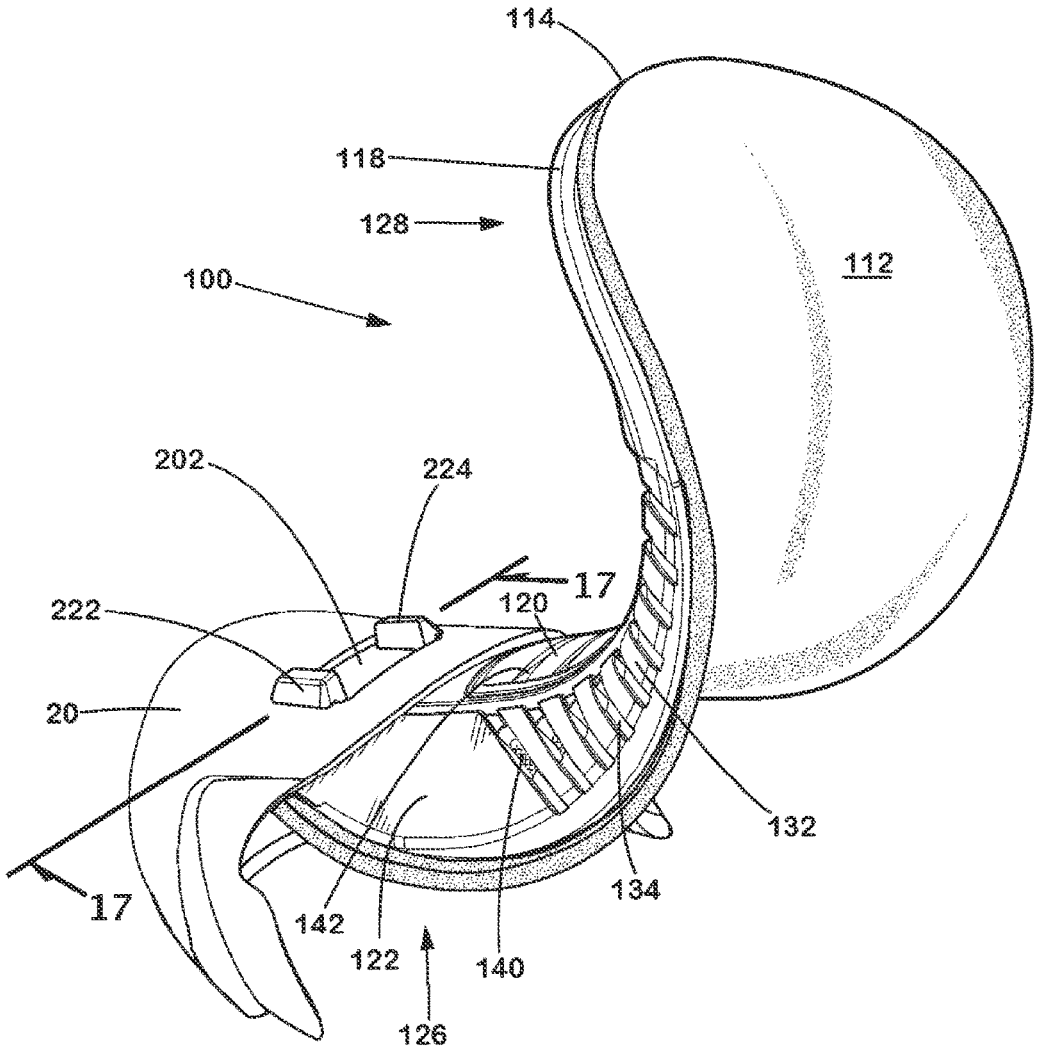
FIG. 15 is a perspective view, taken from a rear, left side, of a tongue, toe cap and connector assembly according to another embodiment.
Figure 16:
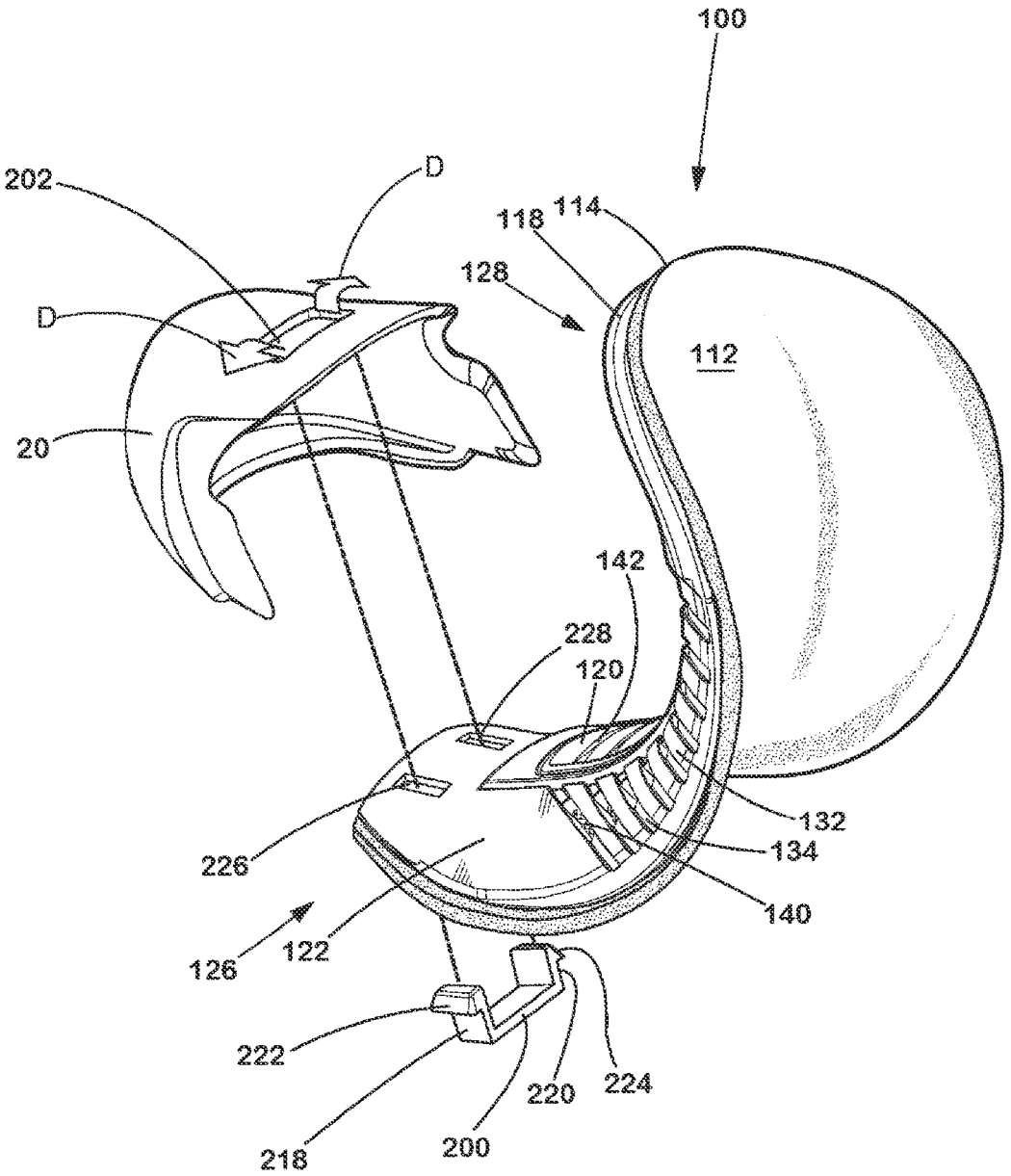
FIG. 16 is a perspective view, taken from a rear, left side, of the tongue, toe cap and connector assembly of FIG. 15, with the tongue, toe cap and connector shown as distinct parts before they are assembled.
Figure 17:
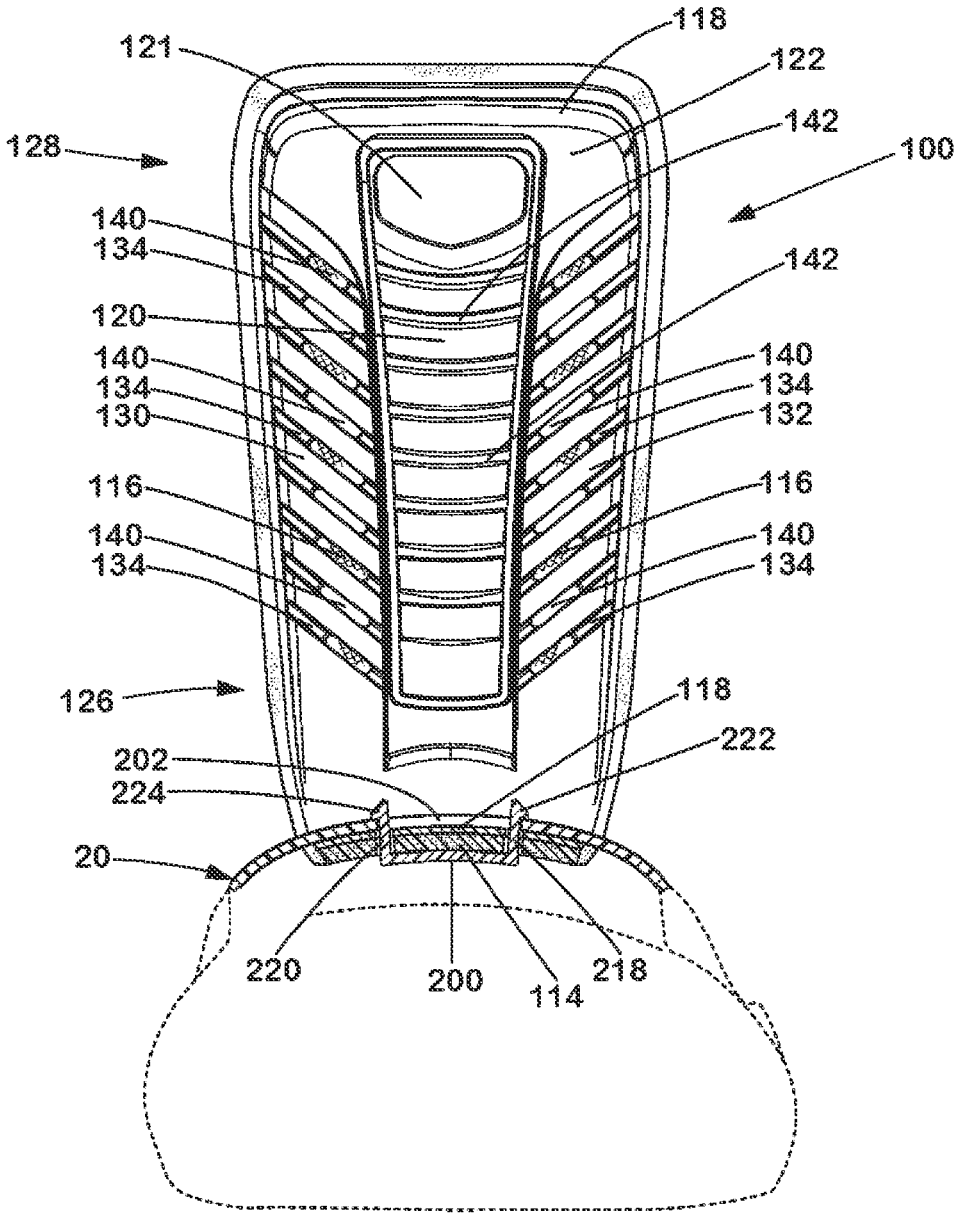
FIG. 17 is a transverse cross-sectional view of a portion of the tongue, toe cap and connector assembly of FIG. 15 taken along line 17-17 in FIG. 15.

In yet another embodiment shown in FIGS. 15, 16 and 17, the connector 200 is not integrally formed with the molded foam body 118 and has two arms 218, 220 having locking means 222, 224 integrally formed therewith. The arms 218, 220 and locking means 222, 224 are adapted to pass through and fit in two apertures 226, 228 defined within the first end 126 of the molded foam body 118 and the aperture 202 defined within the toe cap 20. The locking means 222, 224 are adapted to cooperate with the edges of the aperture 202 (see arrows "D" in FIG. 16) to releasably secure the connector 200 to the toe cap 20, thereby tightly but releasably securing the molded foam body 118 to the toe cap 20, and therefore the tongue 100 to the skate boot 12.

Figure 18A:
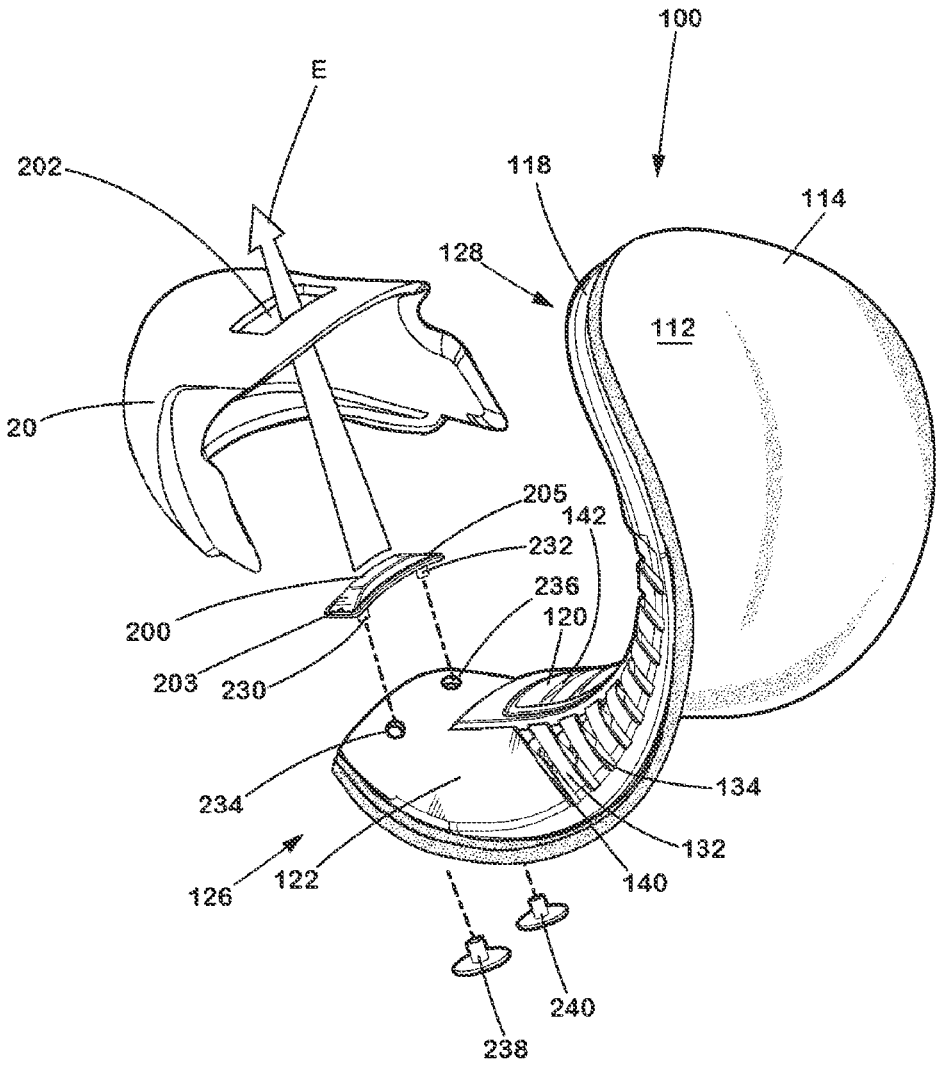
FIG. 18A is a perspective view, taken from a rear, left side, of a tongue, toe cap and connector assembly according to another embodiment, with the tongue, toe cap and connector shown as distinct parts before they are assembled.
Figure 18B:
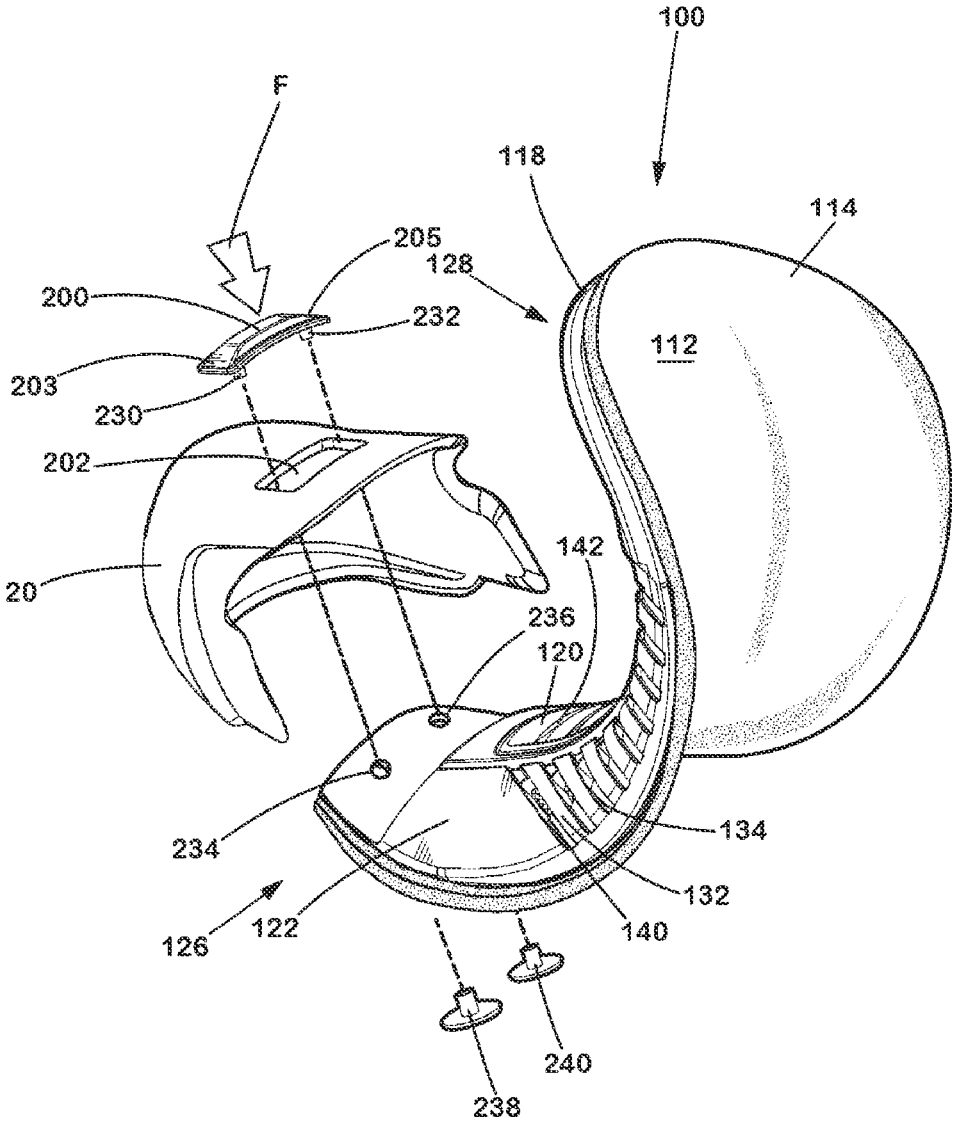
FIG. 18B is a perspective view, taken from a rear, left side, of a tongue, toe cap and connector assembly according to another embodiment, with the tongue, toe cap and connector shown as distinct parts before they are assembled.

In a further embodiment shown in FIG. 18, the connector 200 is not integrally formed with the molded foam body 118. As with the embodiment shown in FIGS. 12, 13 and 14 discussed above, the connector 200 is adapted to pass through (see arrow "E" in FIG. 18A) and fit in the aperture 202 defined within the toe cap 20. The lateral portions 203, 205 of the connector 200 cooperate with the edges of the aperture 202 to snap the connector 200 to the toe cap 20. However, in this embodiment, two protrusions 230, 232 extend from the connector. Protrusions 230, 232 are adapted to pass through and fit in apertures 234, 236 defined within the first end 126 of the molded foam body 118. Elements 238, 240 are adapted to cooperate with the protrusions 230, 232 to releasably secure the connector 200 to the molded foam body 118, thereby releasably securing the tongue 100 to the toe cap 20 (and to the skate boot 12). As in the embodiment shown in FIGS. 12, 13 and 14, the tongue 100 and toe cap 20 can be releasably secured to each other in two steps: first the connector 200 is releasably secured to the tongue 100 using the elements 238, 240, then the connector 200 is snapped in the aperture 202. It is also contemplated that in another embodiment shown in FIG. 18B, the two steps for securing the tongue 100 to the toe cap 20 can be as follows: first the connector 200 is fitted into the aperture 202 from the outer surface of the toe cap 20 (see arrow "F" in FIG. 18B), and then the protrusions 230, 232 are introduced in the apertures 234, 236 and the elements 238, 240 are used to releasably secure the tongue 100 to the connector 200 and toe cap 20.

It is contemplated that in the embodiments shown in FIGS. 12, 13, 14 and 18, the protrusions 201, 230, 232 and elements 208, 238, 240 can cooperate in a variety of manners: as a screw and nut assembly, as a rivet, by tightly forcing the protrusions 201, 230, 232 in the elements 208, 238, 240, or by any other suitable means.

It is also contemplated that in the embodiments shown in FIGS. 12, 13, 14 and 18, the connector 200 can be releasably secured to the toe cap 20 by providing a connector 200 having lateral portions 203, 205 that are adapted to allow a skate owner to unsnap the connector 200 from the toe cap 20. It is contemplated that this may be done by providing a connector 200 shaped and/or made of a flexible material allowing for the snapping and unsnapping of the connector 200 to the toe cap 20. When the connector 200 and toe cap 20 are releasably secured to each other in such a way, it is contemplated that the connector 200 and tongue 100 may be permanently secured to each other, for example, by gluing or welding the protrusions 201, 230, 232 to the elements 208, 238, 240, or by using any other suitable fastener. It is further contemplated that in such embodiments, the connector 200 can be integrally formed with the molded foam body 118.

It is also contemplated that in other embodiments, the connector 200 may be permanently or releasably, as the case may be, secured to the first end 126 of the molded foam body 118 using any suitable fastening or connecting means.

It is contemplated that in some embodiments, the tongue 100 can be permanently connected to one of the toe cap 20 and shell 19, or to both of them, by any suitable fastener or connecting means, including one or more rivets, glue or other suitable adhesive, stitches, and the like, or a combination of those fasteners or connecting means. As an example, in the embodiment shown in FIG. 19, the tongue 100 is stitched to the toe cap 20 (stitching lines 160).

It is also contemplated that in alternate embodiments, the tongue 100 can be releasably connected to one of the toe cap 20 and shell 18, or to both of them, by any suitable fastener or connecting means, including one or more snap fasteners, one or more hook and loop fasteners, one or more zip or slide fasteners, one or more rivets, one or more bolt and nut assemblies, and the like, or a combination of those fasteners or connecting means.

It is contemplated that by providing a tongue 100 that is releasably connected to one of the toe cap 20 and shell 18, or to both of them, the user of the skate boot 12 can change, by himself, the tongue 100 with another tongue such as the tongue 100. Also, manufacturers of skates can make a (relatively) limited number of skate boots such as the skate boot 12, without tongues such as the tongue 100 and separately make the tongues, thus allowing a person purchasing skates to select a skate boot that best suits their needs and then select a tongue that best suits their needs to connect to their skate boot. Should the person purchasing the skates have more than one specific need, then the person can purchase multiple tongues, each one being adapted to one specific need, and change the tongue on the skate boot as needed.

It is also contemplated that for a skate boot such as the skate boot 12, the user can select a tongue such as the tongue 100, from a family of tongues. For example, a first tongue could be made entirely of foam, a second tongue could be made of a foam body and a felt backing, and a third tongue could be a different color (e.g., home or away colors for skaters involved in competitive sports such as ice hockey). It is also contemplated that different members of the family of tongues could also have different thicknesses, hardnesses, densities, colors, and/or shapes, and that one tongue of the family of tongues could be made of multiple layers and that another tongue of the family of tongues could be made of a single layer or of a different number or layers. To change the selected tongue, the selected tongue simply needs to be disconnected and replaced by another tongue selected from the family of tongues.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A skate boot comprising:

a shell shaped to enclose a heel, portions of an Achilles tendon, and medial and lateral surfaces of a foot of a wearer of the skate boot when the skate is in use by the wearer;

a toe cap connected to the shell and shaped to cover toes of the wearer when the skate is in use by the wearer, the toe cap having an aperture defined therethrough;

a tongue shaped to cover at least a portion of a forefoot of the wearer when the skate is in use by the wearer, the tongue and the toe cap overlapping each other along at least a portion of the toe cap that defines the aperture therein;

a connector connecting the tongue and the toe cap, the connector having a bottom surface connected to the tongue and a top surface spaced apart from the bottom surface, the connector extending from the bottom surface to the top surface in a direction extending upwardly away from the tongue such that the connector protrudes from the tongue in said direction, the connector extending through the aperture of the toe cap with a portion of the connector including the top surface extending outwardly from the aperture of the toe cap, the portion having apertures defined therethrough; and a lace engaged to the skate boot, the lace extending through the apertures of the connector to secure the tongue to the toe cap.

2. The skate boot of claim 1, wherein the tongue comprises:

at least one exposed structural molded foam body, and a plurality of apertures defined within the at least one exposed structural molded foam body.

3. The skate boot of claim 1, wherein the skate boot is for one of an ice skate and a roller skate.

4. The skate boot of claim 2, wherein:

the at least one exposed structural molded foam body defines a central longitudinal axis;

the plurality of apertures is at least two apertures; and at least one of the at least two apertures is disposed on one side of the central longitudinal axis and at least one other of the at least two apertures is disposed on another side of the central longitudinal axis.

5. The skate boot of claim 2, wherein a plurality of recesses is defined in the at least one exposed structural molded foam body, and wherein:

the at least one exposed structural molded foam body defines a central longitudinal axis and has an outer surface;

the plurality of recesses is at least two grooves defined within the outer surface of the molded foam body; and at least one of the at least two grooves is disposed on one side of the central longitudinal axis and at least one other of the at least two grooves is disposed on another side of the central longitudinal axis.

6. The skate boot of claim 5, wherein the at least two grooves extend so as to define at least one angle with respect to the central longitudinal axis.

7. The skate boot of claim 2, wherein a plurality of recesses is defined in the at least one exposed structural molded foam body, and wherein at least one of the plurality of apertures is disposed within at least one of the plurality of recesses.

8. The skate boot of claim 5, wherein:

the plurality of apertures is at least two apertures; and at least one of the at least two apertures is disposed within at least one of the two grooves and at least one other of the at least two apertures is disposed within another of the at least two grooves.

9. The skate boot of claim 1 wherein the tongue includes at least one exposed structural molded foam body made of one of injected foam, compressed foam and expanded foam.

10. The skate boot of claim 1, wherein the tongue includes at least one exposed structural molded foam body made of expanded ethylene-vinyl acetate (EVA) foam.

11. The skate boot of claim 1, wherein the tongue includes a molded foam body having a Shore D durometer ranging from approximately 40 to approximately 80.

12. The skate boot of claim 1, wherein the tongue includes a molded foam body having a Shore D durometer ranging from approximately 55 to approximately 65.

13. The skate boot of claim 1, wherein the tongue comprises a back liner for facing a user's foot.

14. The skate boot of claim 1, wherein the toe cap has a top surface defining at least one edge of the aperture of the toe cap, wherein:

at least one portion of the connector is adapted to cooperate with the at least one edge of the aperture of the top surface of the toe cap.

15. The skate boot of claim 14, wherein the at least one portion of the connector that is adapted to cooperate with the at least one edge of the aperture of the top surface of the toe cap cooperates with the at least one edge of the aperture of the top surface of the toe cap so as to releasably secure the tongue to the skate boot.

16. The skate boot of claim 1, wherein the tongue includes at least one aperture receiving at least a portion of the connector.

17. The skate boot of claim 1, wherein the connector is engaged to the aperture of the toe cap with a snap fit.

18. The skate boot of claim 1, wherein the tongue includes apertures aligned with the apertures of the connector, the lace extending through the aligned apertures of the tongue and connector.

* * * * *